US009263054B2

(12) United States Patent
Subasingha et al.

(10) Patent No.: US 9,263,054 B2
(45) Date of Patent: Feb. 16, 2016

(54) SYSTEMS AND METHODS FOR CONTROLLING AN AVERAGE ENCODING RATE FOR SPEECH SIGNAL ENCODING

(71) Applicant: QUALCOMM Incorporated, San Diego, CA (US)

(72) Inventors: Subasingha Shaminda Subasingha, San Diego, CA (US); Vivek Rajendran, San Diego, CA (US); Venkatesh Krishnan, San Diego, CA (US); Venkatraman Srinivasa Atti, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 286 days.

(21) Appl. No.: 14/015,984

(22) Filed: Aug. 30, 2013

(65) Prior Publication Data

US 2014/0236587 A1 Aug. 21, 2014

Related U.S. Application Data

(60) Provisional application No. 61/767,439, filed on Feb. 21, 2013.

(51) Int. Cl.
*G10L 19/24* (2013.01)
*G10L 19/12* (2013.01)

(52) U.S. Cl.
CPC ..... *G10L 19/12* (2013.01); *G10L 19/24* (2013.01)

(58) Field of Classification Search
CPC ..... G10L 19/24
USPC ..... 704/219
See application file for complete search history.

(56) References Cited

U.S. PATENT DOCUMENTS

| | | | | |
|---|---|---|---|---|
| 4,379,949 | A | 4/1983 | Chen et al. | |
| 5,911,128 | A | 6/1999 | DeJaco | |
| 6,240,387 | B1 * | 5/2001 | DeJaco | 704/221 |
| 6,330,532 | B1 * | 12/2001 | Manjunath et al. | 704/219 |
| 6,438,518 | B1 | 8/2002 | Manjunath et al. | |
| 6,484,138 | B2 * | 11/2002 | DeJaco | 704/221 |
| 7,054,809 | B1 * | 5/2006 | Gao | 704/229 |
| 7,657,427 | B2 * | 2/2010 | Jelinek | 704/208 |
| 8,352,252 | B2 * | 1/2013 | Fang et al. | 704/219 |
| 2005/0177364 | A1 | 8/2005 | Jelinek | |

(Continued)

FOREIGN PATENT DOCUMENTS

| | | |
|---|---|---|
| EP | 1339044 | 6/2010 |
| TW | 201248618 A | 12/2012 |

OTHER PUBLICATIONS

International Search Report and Written Opinion—PCT/US2013/057869—ISA/EPO—Dec. 20, 2013.

"High Rate Speech Service Option 17 for Wide Band Spread Spectrum Communication Systems", 3GPP2 Draft; C. S0020-A, 3rd Generation Partnership Project 2, 3GPP2, 2500 Wilson Boulevard, Suite 300, Arlington, Virginia 22201 ; USA, vol. TSGC, no. Version 1.0 Apr. 11, 2004 (2004), pp. 1-127.

(Continued)

*Primary Examiner* — Susan McFadden
(74) *Attorney, Agent, or Firm* — Austin Rapp & Hardman

(57) ABSTRACT

A method for controlling an average encoding rate by an electronic device is described. The method includes obtaining a speech signal. The method also includes determining a first average rate. The method further includes determining a first threshold based on the first average rate. The method additionally includes controlling the average encoding rate by determining at least one other threshold based on the first threshold. The method also includes sending an encoded speech signal.

44 Claims, 13 Drawing Sheets

(56) References Cited

U.S. PATENT DOCUMENTS

| | | | |
|---|---|---|---|
| 2005/0267746 | A1 | 12/2005 | Jelinek et al. |
| 2007/0171931 | A1 | 7/2007 | Manjunath et al. |
| 2007/0244695 | A1 | 10/2007 | Manjunath et al. |
| 2008/0255860 | A1 | 10/2008 | Osada |
| 2012/0303362 | A1 | 11/2012 | Duni et al. |

OTHER PUBLICATIONS

Paksoy E, et al., "Variable Bit-Rate CELP Coding of Speech With Phonetic Classification", European Transactions on Telecommunications and Related Technologies, AEI, Milano, IT, vol. 5, No. 5, Sep. 1, 1994, pp. 57-67, ISSN: 1120-3862.

Taiwan Search Report—TW103101041—TIPO—Jan. 14, 2015.

* cited by examiner

SYSTEMS AND METHODS FOR CONTROLLING AN AVERAGE ENCODING RATE FOR SPEECH SIGNAL ENCODING

RELATED APPLICATIONS

This application is related to and claims priority to U.S. Provisional Patent Application Ser. No. 61/767,439 filed Feb. 21, 2013, for "SYSTEMS AND METHODS FOR CONTROLLING AN AVERAGE RATE."

TECHNICAL FIELD

The present disclosure relates generally to electronic devices. More specifically, the present disclosure relates to systems and methods for controlling an average encoding rate.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform new functions and/or that perform functions faster, more efficiently or with higher quality are often sought after.

Some electronic devices (e.g., cellular phones, smartphones, audio recorders, camcorders, computers, etc.) utilize audio signals. These electronic devices may encode, store and/or transmit the audio signals. For example, a smartphone may obtain, encode and transmit a speech signal for a phone call, while another smartphone may receive and decode the speech signal.

However, particular challenges arise in encoding, transmitting and/or decoding of audio signals. For example, an electronic device may encode an audio signal at an undesirable rate, which may occupy too much transmission bandwidth. As can be observed from this discussion, systems and methods that improve encoding may be beneficial.

SUMMARY

A method for controlling an average encoding rate by an electronic device is described. The method includes obtaining a speech signal. The method also includes determining a first average rate. The method further includes determining a first threshold based on the first average rate. The method additionally includes controlling the average encoding rate by determining at least one other threshold based on the first threshold. The method also includes sending an encoded speech signal. The first threshold may classify a frame as a clean frame or a noisy frame. The at least one other threshold may be a threshold set.

Controlling the average encoding rate may also include determining a frame pattern. A first frame pattern may require a minimum number of high-rate frames between low-rate frames and a second frame pattern may only allow a maximum number of low-rate frames between high-rate frames.

Determining the at least one other threshold may be further based on a metric. Determining the at least one other threshold may include selecting a first threshold set if the metric is not greater than the first threshold and selecting a second threshold set if the metric is greater than the first threshold. The first threshold set may be a first frame adjustment threshold set and the second threshold set may be a second frame adjustment threshold set.

Controlling the average encoding rate may include adjusting the first threshold based on the first average rate. Controlling the average encoding rate may include adjusting at least one voicing threshold based on the first average rate. Adjusting the at least one voicing threshold may include selecting a voicing threshold set.

An electronic device for controlling an average encoding rate is also described. The electronic device includes average rate determination circuitry that determines a first average rate. The electronic device also includes threshold determination circuitry that determines a first threshold based on the first average rate. The electronic device further includes encoding rate controller circuitry that includes the average rate determination circuitry and the threshold determination circuitry. The encoding rate controller controls the average encoding rate by determining at least one other threshold based on the first threshold.

A computer-program product for controlling an average encoding rate is also described. The computer-program product includes a non-transitory tangible computer-readable medium with instructions. The instructions include code for causing an electronic device to obtain a speech signal. The instructions also include code for causing the electronic device to determine a first average rate. The instructions further include code for causing the electronic device to determine a first threshold based on the first average rate. The instructions additionally include code for causing the electronic device to control the average encoding rate by determining at least one other threshold based on the first threshold. The instructions also include code for causing the electronic device to send an encoded speech signal.

An apparatus for controlling an average encoding rate is also described. The apparatus includes means for obtaining a speech signal. The apparatus also includes means for determining a first average rate. The apparatus further includes means for determining a first threshold based on the first average rate. The apparatus additionally includes means for controlling the average encoding rate by determining at least one other threshold based on the first threshold. The apparatus also includes means for sending an encoded speech signal.

DETAILED DESCRIPTION

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

Figure 1:
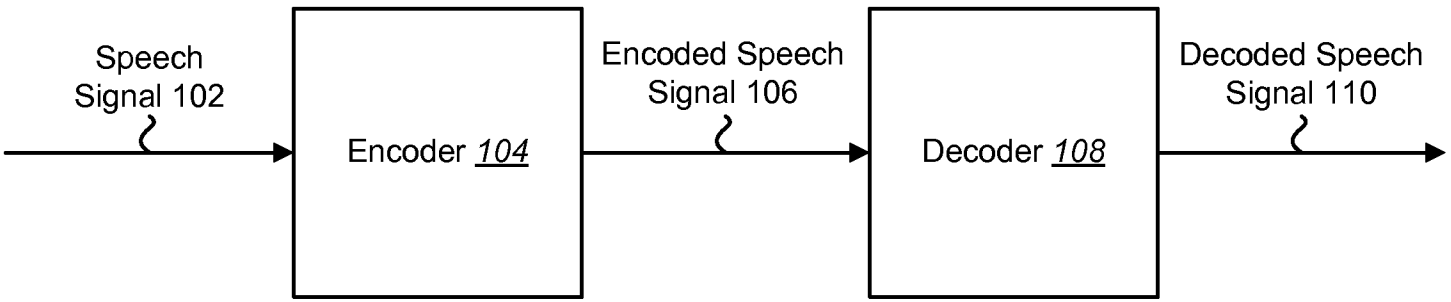
FIG. 1 is a block diagram illustrating a general example of an encoder and a decoder.

FIG. 1 is a block diagram illustrating a general example of an encoder 104 and a decoder 108. The encoder 104 receives a speech signal 102. The speech signal 102 may be a speech signal in any frequency range. For example, the speech signal 102 may be a full band signal with an approximate frequency range of 0-24 kilohertz (kHz), a superwideband signal with an approximate frequency range of 0-16 kHz, a wideband signal with an approximate frequency range of 0-8 kHz or a narrowband signal with an approximate frequency range of 0-4 kHz. Other possible frequency ranges for the speech signal 102 include 300-3400 Hz (e.g., the frequency range of the Public Switched Telephone Network (PSTN)), 14-20 kHz, 16-20 kHz and 16-32 kHz. In some configurations, the speech signal 102 may be sampled at 16 kHz and may have an approximate frequency range of 0-8 kHz.

The encoder 104 encodes the speech signal 102 to produce an encoded speech signal 106. In general, the encoded speech signal 106 includes one or more parameters that represent the speech signal 102. One or more of the parameters may be quantized. Examples of the one or more parameters include filter parameters (e.g., weighting factors, line spectral frequencies (LSFs), line spectral pairs (LSPs), immittance spectral frequencies (ISFs), immittance spectral pairs (ISPs), partial correlation (PARCOR) coefficients, reflection coefficients and/or log-area-ratio values, etc.) and parameters included in an encoded excitation signal (e.g., gain factors, pitch lag, (quantized) amplitude information, (quantized) phase information, adaptive codebook indices, adaptive codebook gains, fixed codebook indices and/or fixed codebook gains, etc.). The parameters may correspond to one or more frequency bands. The decoder 108 decodes the encoded speech signal 106 to produce a decoded speech signal 110. For example, the decoder 108 constructs the decoded speech signal 110 based on the one or more parameters included in the encoded speech signal 106. The decoded speech signal 110 may be an approximate reproduction of the original speech signal 102.

The encoder 104 may be implemented in hardware (e.g., circuitry), software or a combination of both. For example, the encoder 104 may be implemented as an application-specific integrated circuit (ASIC) or as a processor with instructions. Similarly, the decoder 108 may be implemented in hardware (e.g., circuitry), software or a combination of both. For example, the decoder 108 may be implemented as an application-specific integrated circuit (ASIC) or as a processor with instructions. The encoder 104 and the decoder 108 may be implemented on separate electronic devices or on the same electronic device.

In some configurations, the encoder 104 and/or decoder 108 may be included in a speech coding system where speech synthesis is done by passing an excitation signal through a synthesis filter to generate a synthesized speech output (e.g., the decoded speech signal 110). In such a system, an encoder 104 receives the speech signal 102, then windows the speech signal 102 to frames (e.g., 20 millisecond (ms) frames) and generates synthesis filter parameters and parameters required to generate the corresponding excitation signal. These parameters may be transmitted to the decoder 108 as an encoded speech signal 106. The decoder 108 may use these parameters to generate a synthesis filter (e.g., 1/A(z)) and the corresponding excitation signal and may pass the excitation signal through the synthesis filter to generate the decoded speech signal 110. FIG. 1 may be a simplified block diagram of such a speech encoder/decoder system.

Figure 2:
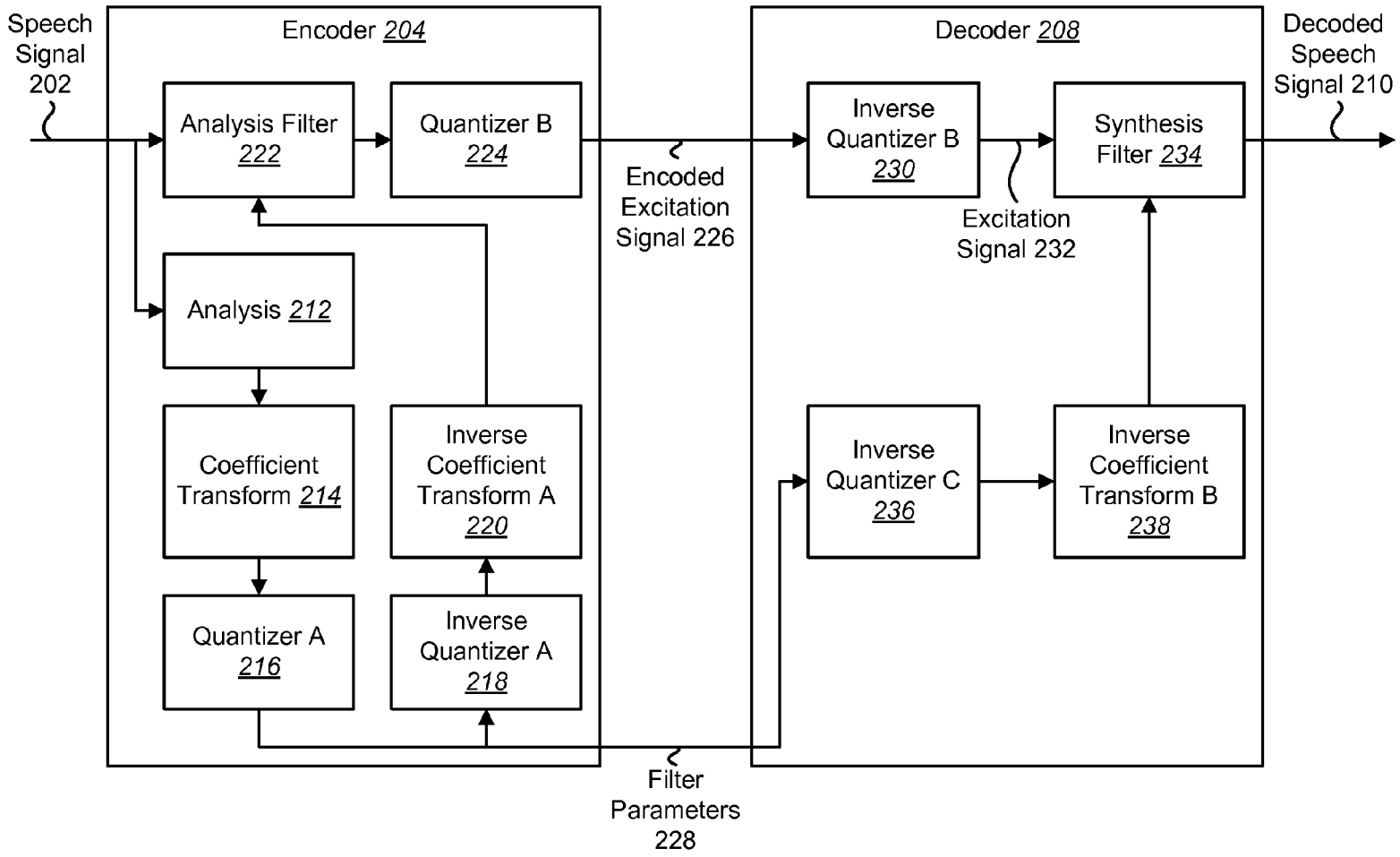
FIG. 2 is a block diagram illustrating an example of a basic implementation of an encoder and a decoder.

FIG. 2 is a block diagram illustrating an example of a basic implementation of an encoder 204 and a decoder 208. The encoder 204 may be one example of the encoder 104 described in connection with FIG. 1. The encoder 204 may include an analysis module 212, a coefficient transform 214, quantizer A 216, inverse quantizer A 218, inverse coefficient transform A 220, an analysis filter 222 and quantizer B 224. One or more of the components of the encoder 204 and/or decoder 208 may be implemented in hardware (e.g., circuitry), software or a combination of both.

The encoder 204 receives a speech signal 202. It should be noted that the speech signal 202 may include any frequency range as described above in connection with FIG. 1 (e.g., an entire band of speech frequencies or a subband of speech frequencies).

In this example, the analysis module 212 encodes the spectral envelope of a speech signal 202 as a set of linear prediction (LP) coefficients (e.g., analysis filter coefficients A(z), which may be applied to produce an all-pole synthesis filter 1/A(z), where z is a complex number). The analysis module 212 typically processes the input signal as a series of non-overlapping frames of the speech signal 202, with a new set of coefficients being calculated for each frame or subframe. In some configurations, the frame period may be a period over which the speech signal 202 may be expected to be locally stationary. One common example of the frame period is 20 ms (equivalent to 160 samples at a sampling rate of 8 kHz, for example). In one example, the analysis module 212 is configured to calculate a set of ten linear prediction coefficients to characterize the formant structure of each 20-ms frame. It is also possible to implement the analysis module 212 to process the speech signal 202 as a series of overlapping frames.

The analysis module 212 may be configured to analyze the samples of each frame directly, or the samples may be weighted first according to a windowing function (e.g., a Hamming window). The analysis may also be performed over a window that is larger than the frame, such as a 30-ms window. This window may be symmetric (e.g., 5-20-5, such that it includes the 5 milliseconds immediately before and after the 20-ms frame) or asymmetric (e.g., 10-20, such that it includes the last 10 ms of the preceding frame). The analysis module 212 is typically configured to calculate the linear prediction coefficients using a Levinson-Durbin recursion or the Leroux-Gueguen algorithm. In another implementation, the analysis module 212 may be configured to calculate a set of cepstral coefficients for each frame instead of a set of linear prediction coefficients.

The output rate of the encoder 204 may be reduced significantly, with relatively little effect on reproduction quality, by quantizing the coefficients. Linear prediction coefficients are difficult to quantize efficiently and are usually mapped into another representation, such as LSFs for quantization and/or entropy encoding. In the example of FIG. 2, the coefficient transform 214 transforms the set of coefficients into a corresponding LSF vector (e.g., set of LSFs). Other one-to-one representations of coefficients include LSPs, PARCOR coefficients, reflection coefficients, log-area-ratio values, ISPs and ISFs. For example, ISFs may be used in the GSM (Global System for Mobile Communications) AMR-WB (Adaptive Multirate-Wideband) codec. For convenience, the term "line spectral frequencies," "LSFs," "LSF vectors" and related terms may be used to refer to one or more of LSFs, LSPs, ISFs, ISPs, PARCOR coefficients, reflection coefficients and log-area-ratio values. Typically, a transform between a set of coefficients and a corresponding LSF vector is reversible, but some configurations may include implementations of the encoder 204 in which the transform is not reversible without error.

Quantizer A 216 is configured to quantize the LSF vector (or other coefficient representation). The encoder 204 may output the result of this quantization as filter parameters 228. Quantizer A 216 typically includes a vector quantizer that encodes the input vector (e.g., the LSF vector) as an index to a corresponding vector entry in a table or codebook.

As seen in FIG. 2, the encoder 204 also generates a residual signal by passing the speech signal 202 through an analysis filter 222 (also called a whitening or prediction error filter) that is configured according to the set of coefficients. The analysis filter 222 may be implemented as a finite impulse response (FIR) filter or an infinite impulse response (IIR) filter. This residual signal will typically contain perceptually important information of the speech frame, such as long-term structure relating to pitch, that is not represented in the filter parameters 228. Quantizer B 224 is configured to calculate a quantized representation of this residual signal for output as an encoded excitation signal 226. In some configurations, quantizer B 224 includes a vector quantizer that encodes the input vector as an index to a corresponding vector entry in a table or codebook. Additionally or alternatively, quantizer B 224 may be configured to send one or more parameters from which the vector may be generated dynamically at the decoder 208, rather than retrieved from storage, as in a sparse codebook method. Such a method is used in coding schemes such as ACELP (algebraic code-excited linear prediction) and codecs such as 3GPP2 (Third Generation Partnership 2) EVRC (Enhanced Variable Rate Codec). In some configurations, the encoded excitation signal 226 and the filter parameters 228 may be included in an encoded speech signal 106.

It may be beneficial for the encoder 204 to generate the encoded excitation signal 226 according to the same filter parameter values that will be available to the corresponding decoder 208. In this manner, the resulting encoded excitation signal 226 may already account to some extent for non-idealities in those parameter values, such as quantization error. Accordingly, it may be beneficial to configure the analysis filter 222 using the same coefficient values that will be available at the decoder 208. In the basic example of the encoder 204 as illustrated in FIG. 2, inverse quantizer A 218 dequantizes the filter parameters 228. Inverse coefficient transform A 220 maps the resulting values back to a corresponding set of coefficients. This set of coefficients is used to configure the analysis filter 222 to generate the residual signal that is quantized by quantizer B 224.

Some implementations of the encoder 204 are configured to calculate the encoded excitation signal 226 by identifying one among a set of codebook vectors that best matches the residual signal. It is noted, however, that the encoder 204 may also be implemented to calculate a quantized representation of the residual signal without actually generating the residual signal. For example, the encoder 204 may be configured to use a number of codebook vectors to generate corresponding synthesized signals (according to a current set of filter parameters, for example) and to select the codebook vector associated with the generated signal that best matches the original speech signal 202 in a perceptually weighted domain.

In some configurations, the encoder 204 may be implemented as a noise-excited linear predictive (NELP) encoder. A NELP encoder may be used to code frames classified as unvoiced speech. NELP coding operates effectively, in terms of signal reproduction, where the speech signal 202 has little or no pitch structure. More specifically, NELP may be used to encode speech that is noise-like in character, such as unvoiced speech or background noise. NELP uses a filtered pseudo-random noise signal to model unvoiced speech. The noise-like character of such speech segments can be reconstructed by generating random signals at the decoder 208 and applying appropriate gains to them. NELP may use a simple model for the coded speech, thereby achieving a lower bit rate.

In some configurations, the encoder 204 may be implemented as a prototype pitch period (PPP) encoder. A PPP encoder may be used to code frames classified as voiced speech. Voiced speech contains slowly time varying periodic components that are exploited by the PPP encoder. The PPP encoder codes a subset of the pitch periods within each frame. The remaining periods of the speech signal 202 are reconstructed by interpolating between these prototype periods. By exploiting the periodicity of voiced speech, the PPP encoder is able to reproduce the speech signal 202 in a perceptually accurate manner.

The decoder 208 may include inverse quantizer B 230, inverse quantizer C 236, inverse coefficient transform B 238 and a synthesis filter 234. Inverse quantizer C 236 dequantizes the filter parameters 228 (an LSF vector, for example), and inverse coefficient transform B 238 transforms the LSF vector into a set of coefficients (for example, as described above with reference to inverse quantizer A 218 and inverse coefficient transform A 220 of the encoder 204). Inverse quantizer B 230 dequantizes the encoded excitation signal 226 to produce an excitation signal 232. Based on the coefficients and the excitation signal 232, the synthesis filter 234 synthesizes a decoded speech signal 210. In other words, the synthesis filter 234 is configured to spectrally shape the excitation signal 232 according to the dequantized coefficients to produce the decoded speech signal 210. In some configurations, the decoder 208 may also provide the excitation signal 232 to another decoder, which may use the excitation signal 232 to derive an excitation signal of another frequency band (e.g., a highband). In some implementations, the decoder 208 may be configured to provide additional information to another decoder that relates to the excitation signal 232, such as spectral tilt, pitch gain and lag and speech mode.

The system of the encoder 204 and the decoder 208 is a basic example of an analysis-by-synthesis speech codec. Codebook excitation linear prediction coding is one popular family of analysis-by-synthesis coding. Implementations of such coders may perform waveform encoding of the residual, including such operations as selection of entries from fixed and adaptive codebooks, error minimization operations and/or perceptual weighting operations. Other implementations of analysis-by-synthesis coding include code-excited linear prediction (CELP), mixed excitation linear prediction (MELP), ACELP, relaxation CELP (RCELP), regular pulse excitation (RPE), multi-pulse excitation (MPE), multi-pulse CELP (MP-CELP) and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10) (which uses residual excited linear prediction (RELP), the GSM enhanced full rate codec (ETSI-GSM 06.60), the ITU (International Telecommunication Union) standard 11.8 kbps G.729 Annex E coder, the IS (Interim Standard)-641 codecs for IS-136 (a time-division multiple access scheme), the GSM adaptive multirate (GSM-AMR) codecs and the 4GV™ (Fourth-Generation Vocoder™) codec (QUALCOMM Incorporated, San Diego, Calif.). The encoder 204 and corresponding decoder 208 may be implemented according to any of these technologies, or any other speech coding technology (whether known or to be developed) that represents a speech signal as (A) a set of parameters that describe a filter and (B) an excitation signal used to drive the described filter to reproduce the speech signal 202.

Even after the analysis filter 222 has removed the coarse spectral envelope from the speech signal 202, a considerable amount of fine harmonic structure may remain, especially for voiced speech. Periodic structure is related to pitch, and different voiced sounds spoken by the same speaker may have different formant structures but similar pitch structures.

Coding efficiency and/or speech quality may be increased by using one or more parameter values to encode characteristics of the pitch structure. One important characteristic of the pitch structure is the frequency of the first harmonic (also called the fundamental frequency), which is typically in the range of 60 to 400 hertz (Hz). This characteristic is typically encoded as the inverse of the fundamental frequency, also called the pitch lag. The pitch lag indicates the number of samples in one pitch period and may be encoded as one or more codebook indices. Speech signals from male speakers tend to have larger pitch lags than speech signals from female speakers.

Another signal characteristic relating to the pitch structure is periodicity, which indicates the strength of the harmonic structure or, in other words, the degree to which the signal is harmonic or non-harmonic. Two typical indicators of periodicity are zero crossings and normalized autocorrelation functions (NACFs). Periodicity may also be indicated by the pitch gain, which is commonly encoded as a codebook gain (e.g., a quantized adaptive codebook gain).

The encoder 204 may include one or more modules configured to encode the long-term harmonic structure of the speech signal 202. In some approaches to CELP encoding, the encoder 204 includes an open-loop LPC analysis module, which encodes the short-term characteristics or coarse spectral envelope, followed by a closed-loop long-term prediction analysis stage, which encodes the fine pitch or harmonic structure. The short-term characteristics are encoded as coefficients (e.g., filter parameters 228), and the long-term characteristics are encoded as values for parameters such as pitch lag and pitch gain. For example, the encoder 204 may be configured to output the encoded excitation signal 226 in a form that includes one or more codebook indices (e.g., a fixed codebook index and an adaptive codebook index) and corresponding gain values. Calculation of this quantized representation of the residual signal (e.g., by quantizer B 224, for example) may include selecting such indices and calculating such values. Encoding of the pitch structure may also include interpolation of a pitch prototype waveform, which operation may include calculating a difference between successive pitch pulses. Modeling of the long-term structure may be disabled for frames corresponding to unvoiced speech, which is typically noise-like and unstructured.

Some implementations of the decoder 208 may be configured to output the excitation signal 232 to another decoder (e.g., a highband decoder) after the long-term structure (pitch or harmonic structure) has been restored. For example, such a decoder may be configured to output the excitation signal 232 as a dequantized version of the encoded excitation signal 226. Of course, it is also possible to implement the decoder 208 such that the other decoder performs dequantization of the encoded excitation signal 226 to obtain the excitation signal 232.

The systems and methods disclosed herein provide approaches for controlling an average encoding rate. For example, some configurations of the systems and methods disclosed herein provide open loop and/or closed loop average encoding rate control for a prototype pitch period (PPP)-based speech encoding system. For clarity, an explanation of some issues that occur in known variable rate encoding systems is given as follows.

In variable rate speech encoding systems, controlling the average encoding rate (e.g., average bit rate, average data rate (ADR), etc.) is utilized to maintain a desired capacity. In a PPP-based speech encoding system, this may be achieved by controlling quarter rate frames (e.g., PPP and/or NELP) frames. For example, Enhanced Variable Rate Codec B (EVRC-B) specifications impose an operating point that has a lower operating bit rate than the desired average encoding rate. Some of the quarter rate PPP frames may be sent in full rate frames until the average encoding rate increases to the desired rate based on last N speech frames. For example, N=600 frames in EVRC-B specifications.

The operating mode may be selected by setting the PPP and full-rate frame pattern such as QFF, QQF (where Q represents quarter rate PPP frames and F represents full rate frames). In this setting, the lowest rate is dependent on the pattern that yields the highest PPP frame rate. However, increasing the consecutive PPP frames may result in drifting the synthesized waveform from the original. This has potential to create speech artifacts.

In EVRC-B specifications, a PPP-based encoding system is associated with a rejection mechanism referred to as a "bump-up scheme." In particular, even though the open loop decision-making process classifies a particular frame to be a PPP frame, the bump up mechanism might change the open loop decision, where that frame will be quantized using full rate. For example, the encoder runs a set of checks to verify whether the given frame is suited for the PPP mode of coding. The encoder checks a set of parameters computed in this process against a set of thresholds. These thresholds are referred to as "bump-up" thresholds. If a "bump up" happens, the given frame is encoded using a higher rate. This increases the average data rate. Accordingly, increasing the PPP frames may not always reduce the rate to the desired lower rate.

Even when a certain operating point is set, the average rate during last N frames (e.g., 600 frames) can be highly variable. Thus, changing the Q frames to F frames based on past N frames might not result in the desired average encoding rate. Accordingly, the measure of the long-term average rate may be considered in the rate control process. Consequently, changing from one operating point to the next most aggressive operating point to control the average rate may not reduce the rate to the desired level in some cases (e.g., for some languages, in some noisy environments, etc.). In experiments, it was found that using the Q and F frame pattern QFF yields the best quality speech as the two F frames provide enough time to recover from the phase alignment errors due to the quarter rate encoding.

Some potential issues associated with rate control in a PPP based variable rate speech coding system are given as follows. Even the most aggressive Q and F pattern might not yield the desired average encoding rate due to speech properties and the bump up mechanism. Imposing a more aggressive rate control pattern may cause speech artifacts. The average rate of the past N frames may not represent the next N frames well. The rate during consecutive N frames can be highly variable.

Figure 3:
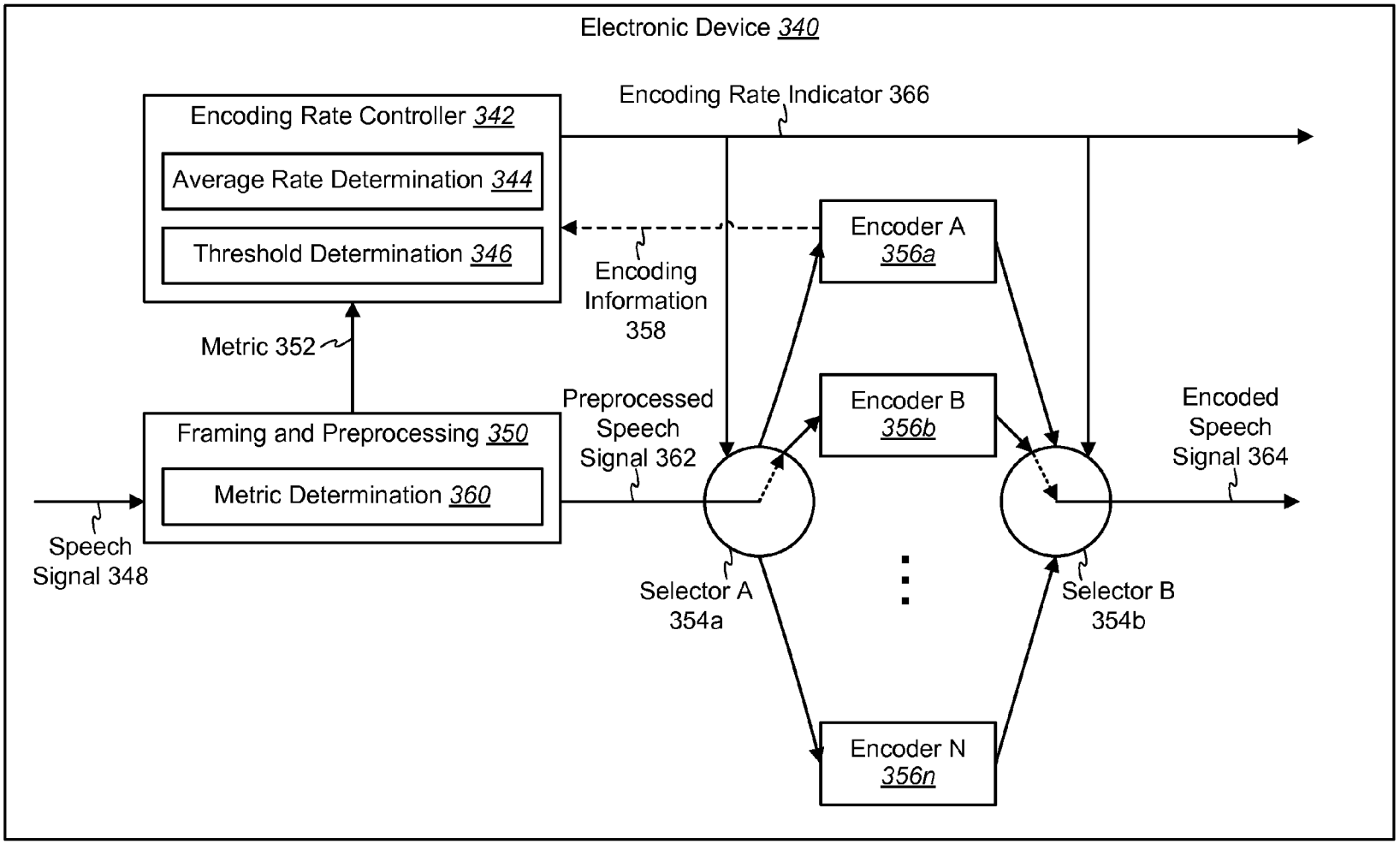
FIG. 3 is a block diagram illustrating one configuration of an electronic device in which systems and methods for controlling an average encoding rate may be implemented.

FIG. 3 is a block diagram illustrating one configuration of an electronic device 340 in which systems and methods for controlling an average encoding rate may be implemented. Examples of the electronic device 340 include smartphones, cellular phones, landline phones, headsets, desktop computers, laptop computers, televisions, gaming systems, audio recorders, camcorders, still cameras, automobile consoles, etc. The electronic device 340 may include an encoding rate controller 342, a framing and preprocessing module 350, selectors 354*a-b* and/or one or more encoders 356*a-n*. One or more of the components of the electronic device 340 may be implemented in hardware (e.g., circuitry), software or a combination of both. For example, the encoding rate controller 342 may be implemented in hardware (e.g., circuitry), software or a combination of both. It should be noted that lines or arrows in the block diagrams herein may denote couplings between components or elements. For example, the encoding rate controller 342 may be coupled to the framing and preprocessing module 350.

The electronic device 340 obtains a speech signal 348. For example, the electronic device 340 may capture the speech signal 348 with one or more microphones and/or may receive the speech signal 348 from another device (e.g., a Bluetooth headset). The speech signal 348 may be provided to the framing and preprocessing module 350.

The framing and preprocessing module 350 may divide the speech signal 348 into a series of frames. Each frame may be a particular time period. For example, each frame may correspond to 20 ms of the speech signal 348. The framing and preprocessing module 350 may perform other operations on the speech signal 348, such as noise suppression and filtering (e.g., one or more of low-pass, high-pass and band-pass filtering). Accordingly, the framing and preprocessing module 350 may produce a preprocessed speech signal 362.

In some configurations, the framing and preprocessing module 350 includes a metric determination module 360. The metric determination module 360 may determine a metric 352 based on the speech signal 348. For example, the metric determination module 360 may determine a signal-to-noise ratio (SNR) based on a frame of the speech signal 348. The metric 352 (e.g., SNR) may be provided to the encoding rate controller 342.

The encoding rate controller 342 may control an average encoding rate. The average encoding rate is a bitrate (in kilobits per second (kbps), for example) of the encoded speech signal 364 based on an average over a number of frames. The encoding rate controller 342 may control the average encoding rate by attempting to match the average encoding rate to a target rate. The target rate may specify a desired bitrate for the encoded speech signal 364. The target rate may be received from another device (e.g., a base station) or may be predetermined.

The encoding rate controller 342 may control the average encoding rate by selecting encoders 356*a-n* to encode frames of the preprocessed speech signal 362. For example, the encoding rate controller 342 may provide an encoding rate indicator 366 to the selectors 354*a-b*. The encoding rate indicator 366 specifies a particular encoder 356, rate and/or frame type. The selectors 354*a-b* may route the preprocessed speech signal 362 to an encoder 356 for each frame as indicated by the encoding rate indicator 366.

Each of the encoders 356*a-n* may produce an encoded speech signal 364 based on the preprocessed speech signal 362. One or more of the encoders 356*a-n* may be implemented in accordance with one or more of the encoders 104, 204 described above. Examples of the encoders 356*a-n* include PPP encoders, NELP encoders, CELP encoders (e.g., ACELP encoders), etc. One or more of the encoders 356*a-n* may provide encoding information 358 to the encoding rate controller 342. Examples of encoding information 358 include encoded waveforms, error metrics (e.g., an amplitude error metric), band gain change metrics (e.g., a low-band gain change metric) and the frame encoding rate used to encode a frame (e.g., an n-th frame). For example, the encoding rate controller 342 may utilize rate information to compute one or more average rates.

Each encoder 356*a-n* may produce the encoded speech signal 364 at a particular encoding rate. As used herein, the term "high-rate encoder" and variations thereof may denote an encoder that produces an encoded speech signal with a higher bitrate than the target rate. Additionally, the term "low-rate encoder" and variations thereof may denote an encoder that produces an encoded speech signal with a lower bitrate than the target rate.

Each encoder 356*a-n* may be utilized to encode one or more frame types. For example, frames may be classified according to frame type based on the speech signal 348 corresponding to each frame. In some configurations, the encoding rate controller 342 may determine whether each frame is a "voiced frame," "unvoiced frame" or other frame (e.g., silence frame, transient frame, down transient frame, etc.). A voiced frame may exhibit voicing characteristics (e.g., more low-band energy, higher SNR, etc.). An unvoiced frame may exhibit noise characteristics (e.g., more high-band energy, lower SNR, etc.). A transient frame may be a frame that occurs between an unvoiced or silence frame and a voiced frame. Accordingly, the encoding rate controller 342 may determine frame type based on one or more thresholds and/or one or more factors (e.g., SNR, zero crossing rate, band energy ratio, etc.). Each frame type may be encoded by one or more encoders 356*a-n* at one or more encoding rates. A frame that is encoded by a high-rate encoder 356 may be referred to as a "high-rate frame" and a frame that is encoded by a low-rate encoder 356 may be referred to as a "low-rate frame." For example, a frame with an encoding rate that is higher than the target rate may be a "high-rate frame" and a frame with an encoding rate that is lower than the target rate may be a "low-rate frame."

In one example, assume that the encoders 356*a-n* include a quarter-rate PPP (QPPP) encoder, a NELP encoder and two ACELP encoders. Further assume that the target rate is 5.9 kbps. The QPPP encoder may encode some voiced frames (e.g., voiced low-rate frames) with an encoding with a rate of 2.8 kbps. The NELP encoder may encode unvoiced frames with an encoding with a rate of 2.8 kbps. Accordingly, the QPPP encoder and the NELP encoder are low-rate encoders in this example. One ACELP encoder (e.g., a "voiced" ACELP encoder) may encode some voiced frames (e.g., voiced high-rate frames) with an encoding with a rate of 7.2 kbps. Another ACELP encoder (e.g., a "transition" ACELP encoder) may encode transition frames with an encoding rate of 8.0 kbps. Accordingly, the voiced ACELP encoder and the transition ACELP encoder are high-rate encoders in this example.

In some examples, the terms "full rate" and/or "quarter rate" may be used to describe frame types and/or corresponding encoders. It should be noted that "full rate" may or may not denote a maximum possible bitrate and/or may denote different bitrates based on frame type. For example, a voiced full-rate frame may be encoded at a bitrate of 7.2 kbps by a voiced ACELP encoder, even though a full-rate transition frame may be encoded at a bitrate of 8.0 kbps by a transition ACELP encoder. It should also be noted that "quarter rate" may or may not denote an actual quarter of the full rate. For example, a quarter-rate frame may be encoded at 2.8 kbps, which is not literally one-fourth of a full-rate 7.2 kbps.

The average rate determination module 344 may determine a first average rate. One example of the first average rate includes a long-term average rate (e.g., $R_{LT}$). For instance, the average rate determination module 344 may determine a short-term average rate (e.g., $R_{lastNframes}$) and/or a long-term average rate. The short-term average rate and the long-term average rate are examples of the average encoding rate. The short-term average rate is an encoding rate averaged over the last N frames (e.g., 600 frames). The average rate determination module 344 may determine the short-term average rate by summing the selected frame encoding rates over N frames and dividing the sum by N. The long-term average rate may be determined (e.g., computed) after each N frame interval in accordance with a smoothing equation given in Equation (1).

$$R_{LT}(n)=\alpha R_{LT}(n-1)+(1-\alpha)R_{lastNframes} \quad (1)$$

In Equation (1), n is a long-term average index and $\alpha$ is a smoothing factor. $\alpha$ may be 0.98 in some configurations. The encoding rate controller 342 may utilize the short-term average rate and/or the long-term average rate to control the average encoding rate.

The threshold determination module 346 may determine one or more thresholds. For example, the threshold determination module 346 may adaptively change one or more thresholds based on an average encoding rate. In particular, the threshold determination module 346 may determine a first threshold (e.g., $TH_{CN}$) based on the first average rate. For example, if the first average rate (e.g., $R_{LT}$) is greater than the target rate (e.g., $R_{target}$), then the threshold determination module 346 may select a first threshold or adjust the first threshold (e.g., increase the first threshold). For example, increasing the first threshold may cause more frames to be classified as clean frames, which may be encoded at a low rate, which causes the average encoding rate to decrease. However, if the first average rate (e.g., $R_{LT}$) is less than or equal to the target rate, then the threshold determination module 346 may select a different first threshold or adjust the first threshold differently (e.g., decrease the first threshold). For example, decreasing the first threshold may cause more frames to be classified as noisy frames, which may be encoded at a high rate, which causes the average encoding rate to increase.

The first threshold (e.g., $TH_{CN}$) may classify a frame as a clean frame or a noisy frame. More specifically, the encoding rate controller 342 may classify a frame as a clean frame or a noisy frame based on the first threshold. For instance, each voiced frame may be classified as a clean frame or a noisy frame. Clean frames may be encoded with a low-rate encoder 356 (e.g., a QPPP encoder) with high probability, while noisy frames may be encoded with a high-rate encoder 356 (e.g., a voiced ACELP encoder) with high probability. It should be noted that not all noisy frames may be encoded with a high-rate encoder 356, though the probability of encoding a noisy frame using a high-rate encoder 356 is high. Thus, determining the first threshold may affect the number of frames that are encoded with a high-rate encoder 356 versus a low-rate encoder 356, which affects the average encoding rate.

In one example, the first threshold is an SNR threshold and the metric 352 is an SNR. The SNR may be based on noise estimation performed by the framing and preprocessing module 350. In this example, the encoding rate controller 342 may classify a frame as a clean frame if the SNR is greater than the SNR threshold or as a noisy frame if the SNR is less than or equal to the SNR threshold.

The encoding rate controller 342 may control an average encoding rate by determining at least one other threshold based on the first threshold. For example, the encoding rate controller 342 may select different thresholds based on the first threshold. Selecting different thresholds may affect the average encoding rate by increasing an amount of high-rate frames (while decreasing an amount of low-rate frames), which increases the average encoding rate, or by decreasing an amount of high-rate frames (while increasing an amount of low-rate frames), which decreases the average encoding rate. In some configurations, the at least one other threshold may be a threshold set. For example, the encoding rate controller 342 may select a first threshold set or a second threshold set based on the first threshold. As used herein, the term "set" may denote two or more elements. For example, a "threshold set" may include two or more thresholds.

In some configurations, the at least one other threshold includes at least one frame adjustment threshold. A frame adjustment threshold may indicate whether to adjust a frame type for a given frame. A frame type adjustment may change (e.g., increase or decrease) the encoding rate for a frame. By changing one or more frame adjustment thresholds, the amount of frame type adjustments can be controlled to increase or decrease an average encoding rate. In some configurations, the frame adjustment threshold(s) may be utilized to determine whether there is a significant amount of quantization error between original speech information and quantized speech information (e.g., whether quantized parameters are too dissimilar from unquantized parameters). If the quantization error is too large, the encoded speech quality may be degraded. In these cases, a frame type may be adjusted to be encoded at a higher rate (e.g., higher quality).

In one example, the encoding rate controller 342 may initially classify a voiced frame as a candidate for low-rate encoding (e.g., QPPP encoding). A low-rate encoder 356 may proceed to encode the voiced frame and may provide encoding information 358 to the encoding rate controller 342.

The encoding rate controller 342 determines whether to adjust the frame type based on the encoding information 358 and the frame adjustment threshold(s). For example, the encoding information 358 may include one or more metrics or information for determining one or more metrics. For instance, the one or more metrics may include a first metric that indicates a degree of difference between the original frame and the encoded frame (e.g., an amplitude error metric) and/or a second metric that indicates a degree of change between a previous frame and a current frame (e.g., a low-band gain change metric). The one or more metrics may be determined by an encoder 356 or the encoding rate controller 342. If the one or more metrics are beyond one or more of the frame adjustment thresholds, the encoding rate controller 342 may adjust the frame type. For example, the encoding rate controller 342 may select a different encoder 356 to encode the frame. For instance, the encoding rate controller 342 may select a high-rate encoder 356 instead of a low-rate encoder 356.

In one example, the at least one threshold is a set of "bump-up" thresholds. The bump-up thresholds indicate whether to adjust (e.g., bump up) a low-rate QPPP frame to a high-rate voiced ACELP frame. For instance, the encoding rate controller 342 may initially classify a voiced frame as a QPPP frame. Accordingly, the encoding rate controller 342 selects a QPPP encoder 356 to encoder the frame. The QPPP encoder 356 encodes the frame and provides encoding information 358 to the encoding rate controller 342.

In this example, the encoding information 358 includes an amplitude error metric and a low-band gain change metric. The amplitude error metric (e.g., amperror) is an average difference between an original PPP signal and a quantized PPP signal as illustrated in Equation (2).

$$amperror = \frac{\sum_{i=1}^{M} |PPP(i) - PPP_Q(i)|}{M} \quad (2)$$

In Equation (2), PPP(i) is an original PPP signal amplitude for an index i, $PPP_Q$ (i) is a quantized PPP signal amplitude, M is a number of bins (e.g., bands) used to compute the PPP amplitudes (in amplitude quantization, for example) and amperror is the amplitude error metric. For example, a PPP signal may be quantized by converting the time domain signal to a frequency domain signal and computing amplitudes for different frequency bands.

The low-band gain change metric (e.g., ΔLgainE) is a difference between a current frame low-band energy gain and a previous frame low-band energy gain as illustrated in Equation (3).

$$\Delta LgainE = currLgainE - prevLgainE \quad (3)$$

In Equation (3), currLgainE is the current frame low-band energy gain, prevLgainE is a previous frame low-band energy gain and ΔLgainE is the low-band gain change metric. The energy gains may be evaluated over a low-band, which is a frequency range between 0 Hz and an upper limit. For example, the low-band may be between 0 and 1104.5 Hz.

In this example, the set of bump-up thresholds includes an amplitude error threshold (e.g., amperrorTH) and a low-band gain change threshold (e.g., ΔLgainETH). In some configurations, amperrorTH=0.47 and ΔLgainETH=−0.4. In this example, the encoding rate controller 342 may adjust (e.g., bump up) the QPPP frame to a voiced ACELP frame if amperror>0.47 and ΔLgainE>−0.4.

In some configurations, determining the at least one other threshold may be further based on the metric 352. For example, the encoding rate controller 342 may select a first threshold set (e.g., a first rate adjustment threshold set) if the metric 352 is not greater than the first threshold or may select a second threshold set (e.g., a second rate adjustment threshold set) if the metric 352 is greater than the first threshold. For example, the encoding rate controller 342 may determine the at least one other threshold by determining whether the metric 352 (e.g., an SNR) is greater than the first threshold (e.g., SNR threshold).

Manipulating the first threshold (e.g., SNR threshold) and/or the at least one other threshold (e.g., frame adjustment thresholds, bump-up thresholds) may affect how frames are classified, which may affect the average encoding rate, since different frame types may be coded at different rates. For example, the average encoding rate may be based on whether a frame is classified as a clean frame or a clean frame and/or whether the frame is classified as a voiced frame, unvoiced frame or generic frame. Examples of encoding rates corresponding to various frame types are given in Table (1).

TABLE (1)

| Frame Type | Rate |
|---|---|
| QPPP | 2.8 kbps |
| NELP | 2.8 kbps |
| Voiced ACELP | 7.2 kbps |
| Transition ACELP | 8.0 kbps |

In some configurations, the encoding rate controller 342 may further control the average encoding rate by determining a frame pattern. For example, controlling the average encoding rate may include determining a frame pattern. The frame pattern may specify a ratio of or required amounts of frames of certain frame types. For example, a first frame pattern (e.g., a "rate-increase frame pattern") may require a minimum number of high-rate frames between low-rate frames and a second frame pattern (e.g., a "rate-decrease frame pattern") may only allow a maximum number of low-rate frames between high-rate frames. If the first average rate is below the target rate, the encoding rate controller 342 may select the first frame pattern, which may increase the average encoding rate. If the first average rate is above the target rate, the encoding rate controller 342 may select the second frame pattern, which may decrease the average encoding rate.

In some configurations, the frame patterns include a "QFF" frame pattern and a "QQF" frame pattern, where "Q" denotes a low-rate frame (e.g., a quarter-rate frame) and "F" denotes a high-rate frame (e.g., a full-rate frame). In these configurations, the QFF frame pattern may require a minimum number of F frames between Q frames. Furthermore, the QQF frame pattern may only allow a maximum number of Q frames between F frames. For example, the QFF pattern may require that at least two F frames occur between Q frames, though more than two consecutive F frames may occur between Q frames. Furthermore, the QQF pattern may only allow a maximum of two consecutive Q frames between F frames, though more than one F frame may occur between Q frames.

In some configurations, the encoding rate controller 342 (e.g., the threshold determination module 346) may further control the average encoding rate by adjusting the at least one other threshold based on the first average rate. For instance, controlling the average encoding rate may further include adjusting the at least one other threshold based on the first average rate.

In one example, the at least one other threshold is at least one frame adjustment threshold. In this example, the encoding rate controller 342 may adjust the at least one frame adjustment threshold by selecting a frame adjustment threshold set. For instance, the encoding rate controller 342 may select a first frame adjustment threshold set if the first average rate is greater than the target rate and may select a second frame adjustment threshold set if the first average rate is not greater than the target rate. The first frame adjustment threshold set may be referred to as a "relaxed frame adjustment threshold set." The first frame adjustment threshold set may result in fewer frame adjustments (e.g., bump-ups), which may lower the average encoding rate. For example, one or more of the frame adjustment thresholds in the first frame adjustment threshold set may be higher than one or more corresponding frame adjustment thresholds in the second frame adjustment threshold set. The second frame adjustment threshold set may be referred to as a "tightened frame adjustment threshold set." The second frame adjustment threshold set may result in more frame adjustments (e.g., bump-ups), which may increase the average encoding rate.

In some configurations, the encoding rate controller 342 (e.g., threshold determination module 346) may further control the average encoding rate by adjusting at least one voicing threshold based on the first average rate. For instance, controlling the average encoding rate further includes adjusting at least one voicing threshold based on the first average rate.

In some configurations, directly adjusting the at least one voicing threshold may be different from determining the at least one other threshold based on the first threshold as described above. For example, directly adjusting the at least one voicing threshold may be based directly on the first average rate (and may not be dictated based on determining another threshold, for instance).

In one example, the encoding rate controller 342 may adjust the at least one voicing threshold by selecting a voicing threshold set. For instance, the encoding rate controller 342 may select a first voicing threshold set if the first average rate is greater than the target rate and may select a second voicing threshold set if the first average rate is not greater than the target rate. The first voicing threshold set may be referred to as a "relaxed voicing threshold set." The first voicing threshold set may result in classifying more frames as voiced frames and/or unvoiced frames (e.g., QPPP frames and/or NELP frames), which may lower the average encoding rate. This may lower the average encoding rate because some voiced frames and/or unvoiced frames may be low-rate frames. For example, one voicing threshold in the first voicing threshold set may be higher than a corresponding voicing threshold in the second voicing threshold set and another voicing threshold in the first voicing threshold set may be lower than a corresponding voicing threshold in the second voicing threshold set. The second voicing threshold set may be referred to as a "tightened voicing threshold set." The second voicing threshold set may result in classifying more frames as generic frames. This may result in increasing the average encoding rate, since generic frames (e.g., transition frames) may be high-rate frames.

In some configurations of the systems and methods disclosed herein, the electronic device 340 may control the average encoding rate based on the long-term average rate and the short-term average rate. In particular, some configurations of the systems and methods disclosed herein present an average encoding rate control strategy based on short-term and long-term average rates. Also, controlling the average encoding rate may be based on multiple steps depending on long-term average rate, short-term average rate (e.g., an average rate during the last N frames) and the target rate. A more specific configuration of the systems and methods disclosed herein is given as follows. In this configuration, one or more procedures relating to items (1)-(4) may be utilized to achieve the desired average encoding rate. The potential impact of speech quality increases as the list of items progresses.

(1) The first threshold (e.g., $TH_{CN}$) for PPP frames may be changed. In particular, there may be two frame adjustment threshold sets that classify clean frames and noisy frames. In general, these frame adjustment thresholds are more stringent for clean frames. Increasing the first threshold enables consideration of more frames as noisy, which results in fewer frame adjustments (e.g., fewer bump-ups). This may reduce the average encoding rate. (2) A frame pattern may be utilized that generates more low-rate frames. For example, a frame pattern may be set to a first frame pattern and the frame pattern may be changed to a second frame pattern to obtain more low-rate frames, which reduces the average encoding rate. (3) The frame adjustment thresholds may be adjusted (e.g., relaxed). This may reduce the number of frame adjustments (e.g., bump-ups) so more low-rate frames are possible. (4) At least one voicing threshold may be adjusted to reduce the rate by increasing low-rate frames (e.g., QPPP frames and NELP frames). This may potentially create speech artifacts.

Apart from average encoding rate reduction mechanisms, the systems and methods disclosed herein may utilize a speech quality improvement strategy if the global rate is less than the target rate by a specific margin. The rate control mechanism used in EVRC-B may be employed to move some percentage of the low-rate frames to high-rate frames, which can increase the speech quality. This may be done by fixing an operating point using a certain Q and F pattern and then moving a certain percentage of Q frame to F frames. EVRC-B picks an operating bit rate that is lower than the target bit rate. Then a ratio (e.g. r %) may be computed such that changing the coding mode of Q frames to F frames by the computed ratio (r %) increases the average rate to the target rate. As some Q frames are instead coded using full rate frames, the overall speech quality improves.

The electronic device 340 may send the encoded speech signal 364. The encoded speech signal 364 and/or the encoding rate indicator 366 may be sent to another device (e.g., electronic device, base station, wireless communication device, etc.) and/or may be sent to memory for storage. For example, the encoded speech signal 364 and the encoding rate indicator 366 may be provided to a radio frequency (RF) transmitter (not shown) included in the electronic device 340. The RF transmitter may then transmit the encoded speech signal 364 to another device using an antenna.

Figure 4:
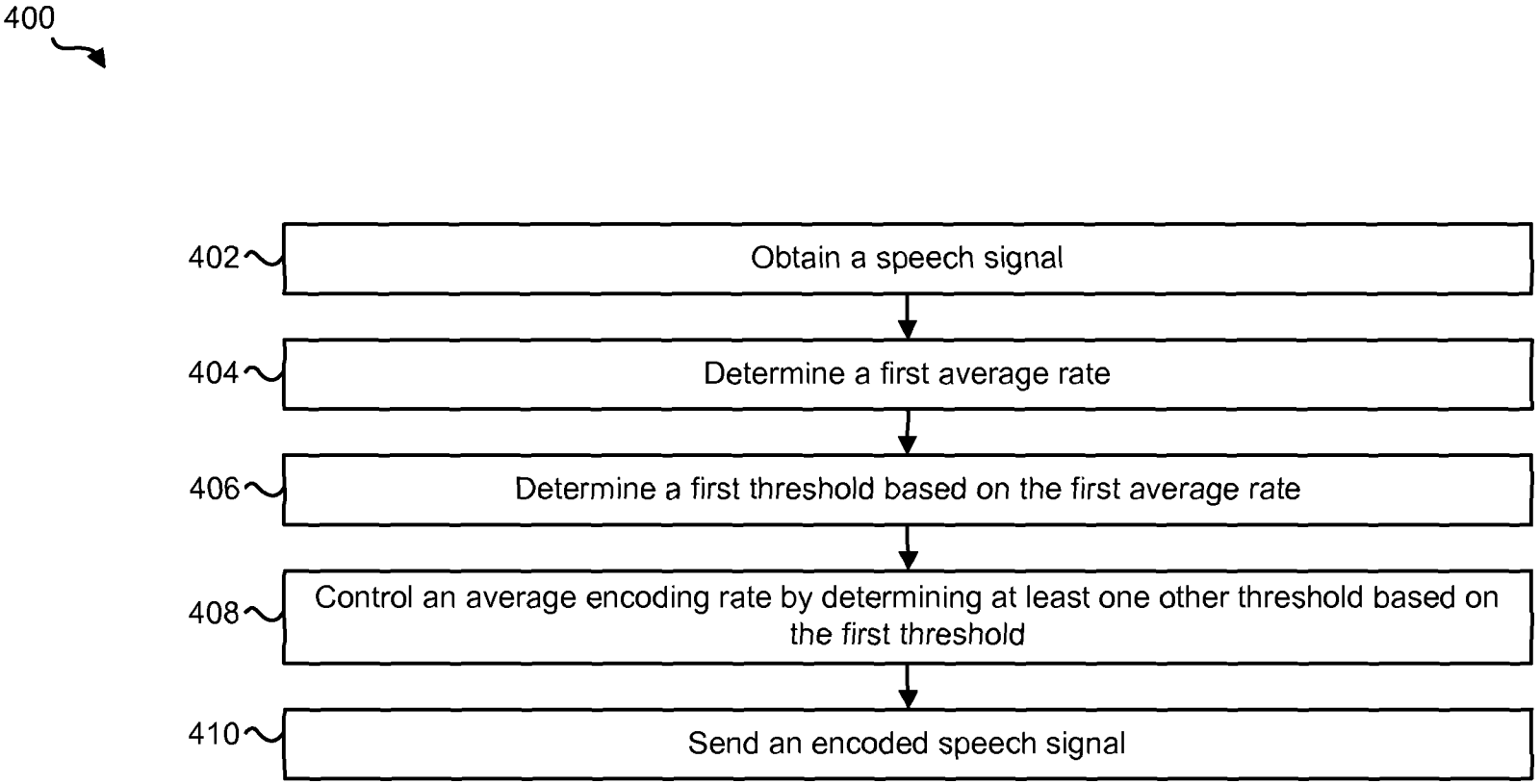
FIG. 4 is flow diagram illustrating one configuration of a method for controlling an average encoding rate.

FIG. 4 is flow diagram illustrating one configuration of a method 400 for controlling an average encoding rate. An electronic device 340 obtains 402 a speech signal 348. For example, the electronic device 340 may capture the speech signal 348 with one or more microphones and/or may receive the speech signal 348 from another device (e.g., a Bluetooth headset).

The electronic device 340 may determine 404 a first average rate. For example, the electronic device 340 may determine a long-term average rate (e.g., $R_{LT}$) and/or a short-term average rate (e.g., $R_{lastNframes}$) as described above in connection with FIG. 3.

The electronic device 340 may determine 406 a first threshold (e.g., $TH_{CN}$) based on the first average rate. For example, the electronic device 340 may select or adjust a first threshold based on the first average rate as described above in connection with FIG. 3.

The electronic device 340 may control 408 an average encoding rate by determining at least one other threshold based on the first threshold. For example, the encoding rate controller 342 may select different thresholds (e.g., frame adjustment threshold sets) based on the first threshold as described above in connection with FIG. 3.

The electronic device 340 may send 410 an encoded speech signal 364. For example, an encoded speech signal 364 and/or an encoding rate indicator 366 may be sent to another device (e.g., electronic device, base station, wireless communication device, etc.) and/or may be sent to memory for storage as described above in connection with FIG. 3.

Figure 5:
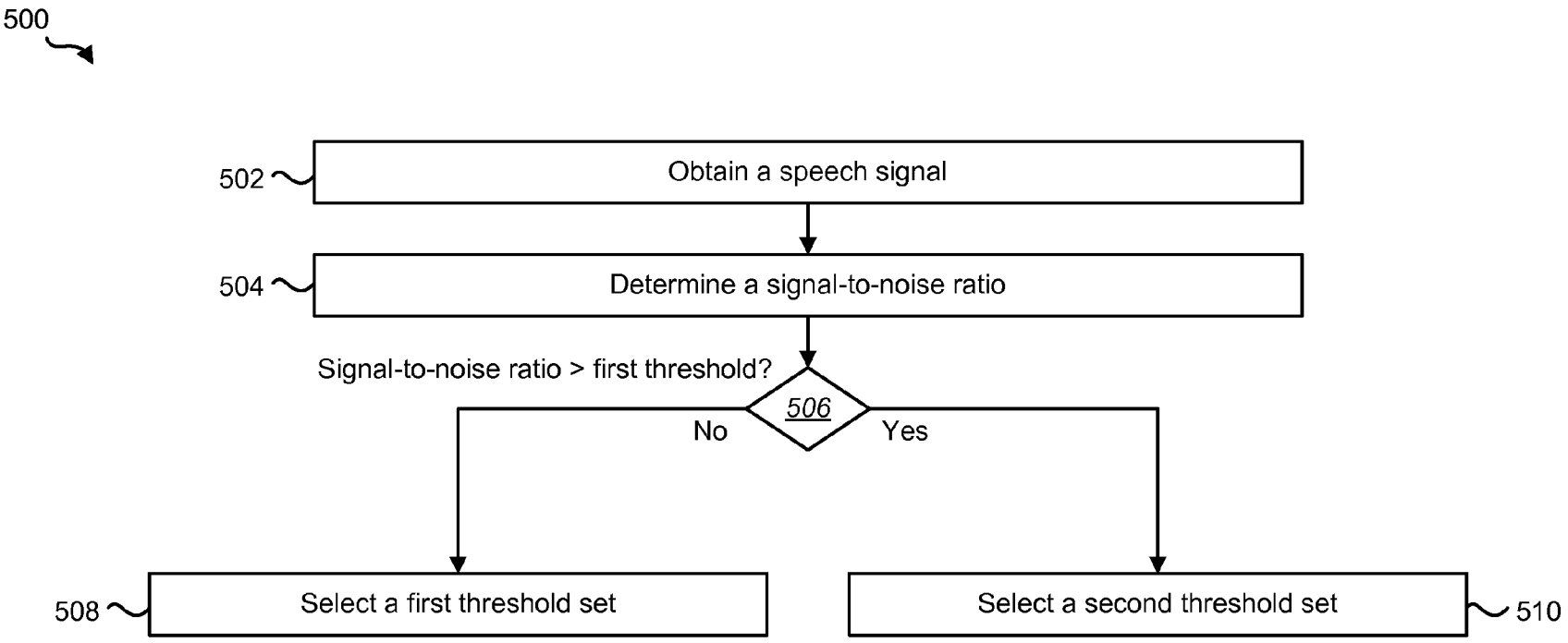
FIG. 5 is a flow diagram illustrating one configuration of a method for determining at least one other threshold based on a first threshold and a metric.

FIG. 5 is a flow diagram illustrating one configuration of a method 500 for determining at least one other threshold based on a first threshold and a metric 352. An electronic device 340 may obtain 502 a speech signal 348. This may be accomplished as described above.

The electronic device 340 may determine 504 an SNR based on the speech signal 348. For example, the electronic device 340 may determine a channel energy estimate and a channel noise energy estimate based on the speech signal 348. The electronic device 340 may then determine 504 an SNR based on a ratio of the channel energy estimate and the channel noise energy estimate.

The electronic device 340 may determine 506 whether the SNR is greater than the first threshold (e.g., $TH_{CN}$, an SNR threshold). If the SNR is not greater than the first threshold, the electronic device 340 may select 508 a first threshold set (e.g., a first frame adjustment threshold set, a first bump-up threshold set, etc.). If the SNR is greater than the first threshold, the electronic device 340 may select 510 a second threshold set (e.g., a second frame adjustment threshold set, a second bump-up threshold set, etc.).

The method 500 includes one example of changing the first threshold (e.g., item (1) described above in connection with FIG. 3). The first threshold (e.g., $TH_{CN}$, SNR threshold, etc.) may be changed adaptively based on the first average rate such that the first threshold set or the second threshold set is selected. This is one example of indirectly selecting the at least one other threshold (e.g., frame adjustment threshold sets) based on the first threshold and a metric 352 (e.g., SNR).

Figure 6:
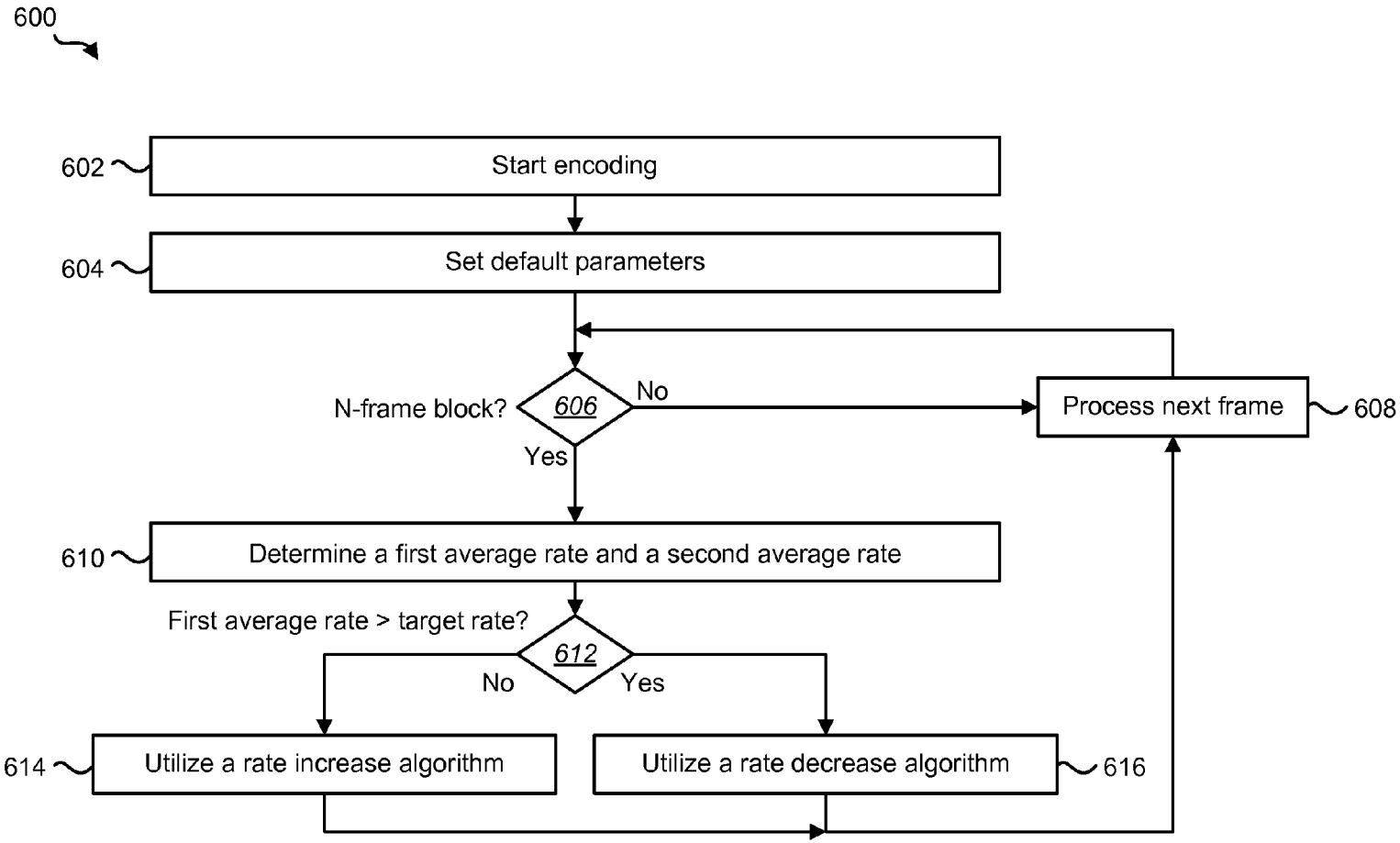
FIG. 6 is a flow diagram illustrating a more specific configuration of a method for controlling an average encoding rate.

FIG. 6 is a flow diagram illustrating a more specific configuration of a method 600 for controlling an average encoding rate. An electronic device 340 may start 602 encoding. For example, the electronic device 340 may obtain a speech signal and begin to encode the speech signal.

The electronic device 340 may set 604 default parameters. Examples of parameters include a first threshold (e.g., $TH_{CN}$), a frame pattern mode, a frame adjustment threshold mode and/or a voicing threshold mode. The frame pattern mode may indicate a frame pattern (e.g., a first frame pattern, a second frame pattern, etc.). The frame adjustment threshold mode may indicate at least one frame adjustment threshold (e.g., a first frame adjustment threshold set and a second frame adjustment threshold set, etc.). The voicing threshold mode may indicate at least one voicing threshold (e.g., a first voicing threshold set, a second voicing threshold set, etc.). The electronic device 340 may utilize the frame pattern as indicated by the frame pattern mode, the frame adjustment threshold(s) as indicated by the frame adjustment threshold mode and/or the voicing threshold(s) as indicated by the voicing threshold mode in determining an encoding rate (e.g., in classifying frames). In one example, setting 604 default parameters may include setting the first threshold to a first threshold maximum (e.g., $TH_{CNmax}$), setting the frame pattern mode to indicate a second frame pattern, setting the frame adjustment threshold mode to indicate a first frame adjustment threshold set (e.g., a relaxed frame adjustment threshold set) and setting the voicing threshold mode to indicate a second voicing threshold set (e.g., a tightened voicing threshold set).

The electronic device 340 may determine 606 whether an N-frame block has been reached. For example, the electronic device 340 may determine whether N frames have been processed (from the start of encoding or since a previous N-frame block). For instance, a frame may be "processed" if an encoding rate has been determined for that frame and/or if that frame has been encoded.

If the N-frame block has not been reached, the electronic device 340 may process 608 a next frame. For example, the electronic device 340 may determine an encoding rate for the next frame and/or may encode the next frame.

If the N-frame block has been reached, the electronic device 340 may determine 610 a first average rate (e.g., a long-term average rate) and a second average rate (e.g., a short-term average rate). This may be accomplished as described above in connection with FIG. 3 and/or FIG. 4.

The electronic device 340 may determine 612 if the first average rate is greater than a target rate. If the first average rate is greater than the target rate, the electronic device 340 may utilize 616 a rate decrease algorithm. If the first average rate is not greater than the target rate, the electronic device 340 may utilize 614 a rate increase algorithm. The rate increase algorithm may adjust one or more parameters in an attempt to increase the average encoding rate. For example, the rate increase algorithm may decrease the first threshold, set the frame pattern mode to indicate the first frame pattern (e.g., a rate-increase frame pattern), set the frame adjustment threshold mode to indicate the second frame adjustment threshold set (e.g., the tightened frame adjustment threshold set) and/or set the voicing threshold mode to indicate the second voicing threshold set (e.g., the tightened voicing threshold set).

If the first average rate is greater than the target rate, the electronic device 340 may utilize 616 a rate decrease algorithm. The rate decrease algorithm may adjust one or more parameters in an attempt to reduce the average encoding rate. For example, the rate decrease algorithm may increase the first threshold, set the frame pattern mode to indicate the second frame pattern (e.g., a rate-decrease frame pattern), set the frame adjustment threshold mode to indicate the first frame adjustment threshold set (e.g., the relaxed frame adjustment threshold set) and/or set the voicing threshold mode to indicate the first voicing threshold set (e.g., the relaxed voicing threshold set).

The electronic device 340 may process 608 the next frame. For example, the electronic device 340 may process the next N-frame block and return to determine 610 a first average rate and so on.

Figure 7:
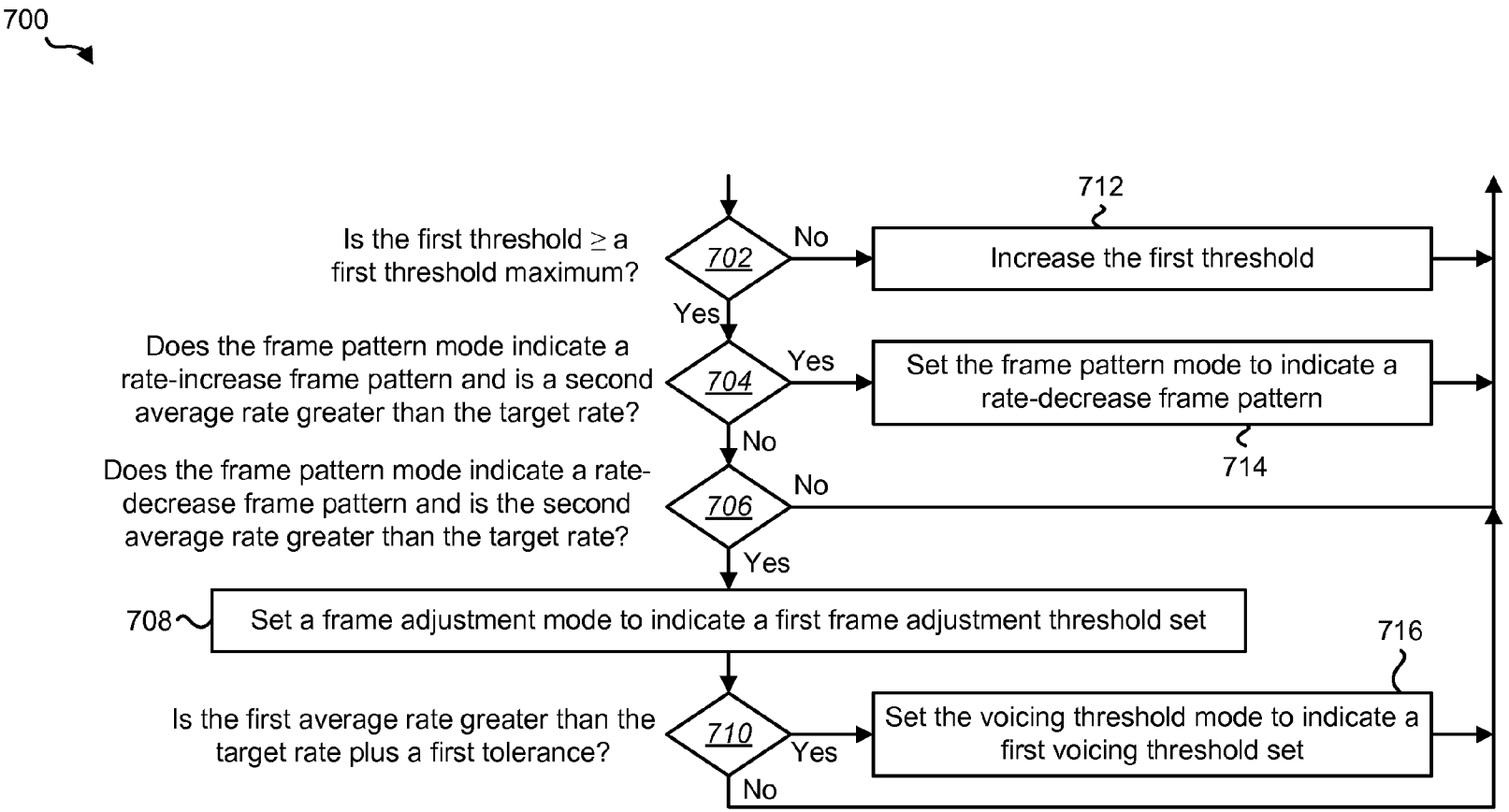
FIG. 7 is a flow diagram illustrating one configuration of a method for decreasing an average encoding rate.

FIG. 7 is a flow diagram illustrating one configuration of a method 700 for decreasing an average encoding rate. The method 700 may be one example of the rate decrease algorithm described in connection with FIG. 6. For example, the method 700 may be performed when first average rate is greater than the target rate.

The electronic device 340 may determine 702 if the first threshold (e.g., $TH_{CN}$) is greater than or equal to a first threshold maximum (e.g., $TH_{CNmax}$). If the first threshold is not greater than or equal to the first threshold maximum, the electronic device 340 may increase 712 the first threshold. For example, the electronic device 340 may increase the first threshold to the first threshold plus a first threshold size factor. The first threshold size factor may specify an amount (e.g., step size) for increasing the first threshold. The electronic device 340 may then return to process the next frame as described in connection with FIG. 6.

If the first threshold is greater than or equal to the first threshold maximum, the electronic device 340 may determine 704 whether a frame pattern mode indicates a rate-increase frame pattern and whether a second average rate (e.g., short-term average rate) is greater than the target rate. If the frame pattern mode indicates a rate-increase frame pattern and the second average rate is greater than the target rate, then the electronic device 340 may set 714 the frame pattern mode to indicate a rate-decrease frame pattern. The electronic device 340 may then return to process the next frame as described in connection with FIG. 6.

If the frame pattern mode does not indicate a rate-increase frame pattern or the second average rate is not greater than the target rate, then the electronic device 340 may determine 706 whether the frame pattern mode indicates a rate-decrease frame pattern and whether the second average rate is greater than the target rate. If the frame pattern mode does not indicate a rate-decrease frame pattern or the second average rate is not greater than the target rate, then the electronic device 340 may return to process the next frame as described in connection with FIG. 6. If the frame pattern mode indicates a rate-decrease frame pattern and the second average rate is greater than the target rate, then the electronic device 340 may set 708 a frame adjustment mode to indicate a first frame adjustment threshold set (e.g., a relaxed frame adjustment threshold set).

The electronic device 340 may determine 710 if the first average rate is greater than the target rate plus a first rate tolerance. The first rate tolerance specifies an amount above the target rate. If the long-term average rate is greater than a target rate plus the first rate tolerance, the electronic device 340 may set 716 the voicing threshold mode to indicate a first voicing threshold set (e.g., a relaxed voicing threshold set). The electronic device 340 may return to process the next frame as described in connection with FIG. 6. If the long-term average rate is not greater than a target rate plus the first rate tolerance, the electronic device 340 may return to process a next frame as described in connection with FIG. 6.

As can be observed in FIG. 7, determining the first threshold (and determining the at least one other threshold based on the first threshold), determining a frame pattern, setting a frame adjustment mode (e.g., adjusting frame adjustment thresholds) and/or (directly) adjusting at least one voicing threshold as described in connection with FIG. 3 may be implemented cumulatively. For example, if the first average rate is above a target rate, successive and additional procedures may be performed until the target rate is reached. For instance, if performing item (1) does not reach the target rate, items (1) and (2) may be performed and so on until all items (1)-(4) are being performed to reduce the average rate.

Figure 8:
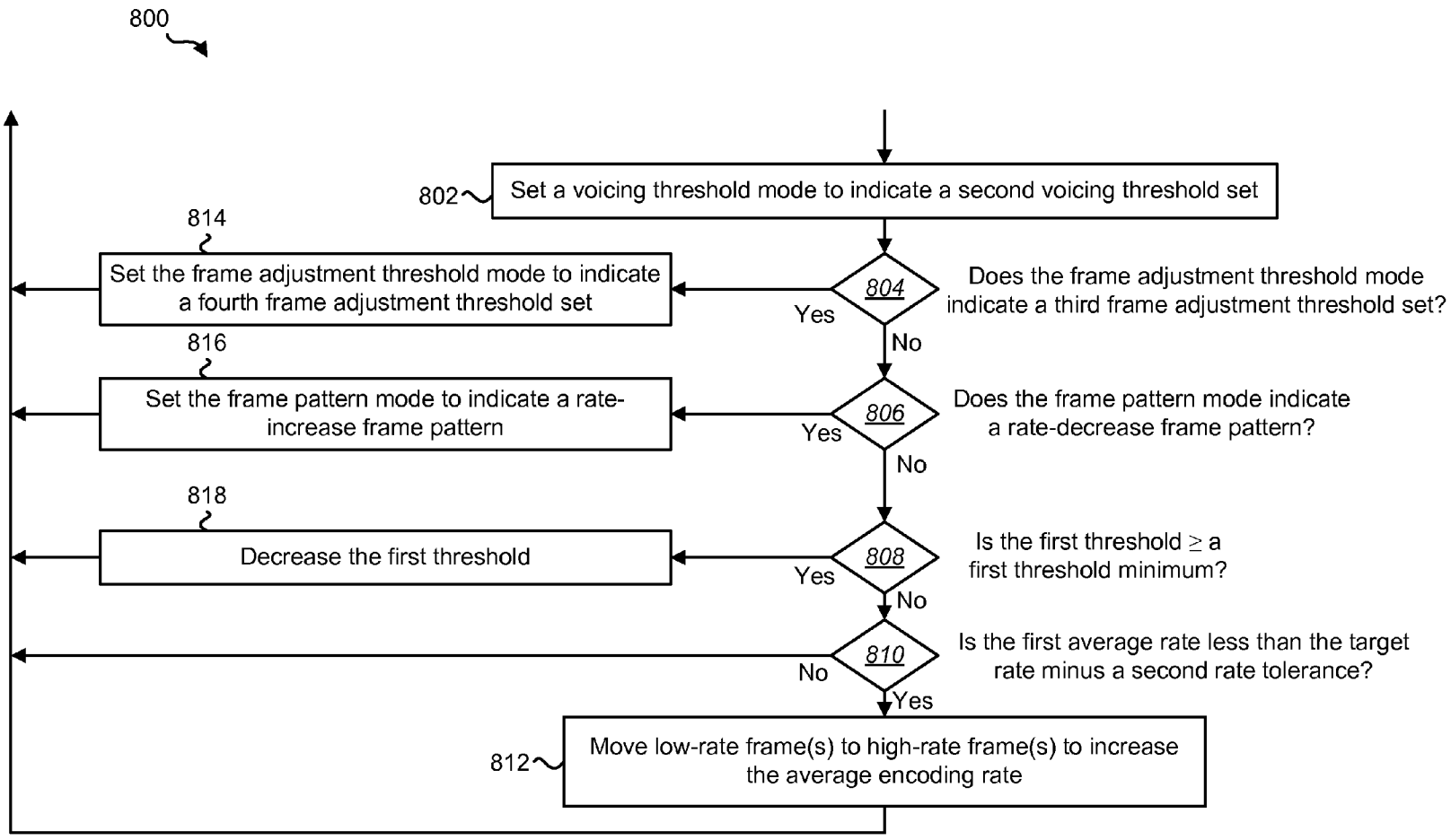
FIG. 8 is a flow diagram illustrating one configuration a method for increasing an average encoding rate.

FIG. 8 is a flow diagram illustrating one configuration a method 800 for increasing an average encoding rate. The method 800 may be one example of the rate increase algorithm described in connection with FIG. 6. For example, the method 800 may be performed when first average rate is not greater than the target rate.

The electronic device 340 may set 802 the voicing threshold mode to indicate a second voicing threshold set (e.g., a tightened voicing threshold set). This may result in more generic frames. Generic frames (e.g., transient frames) may be encoded with a high-rate encoder (e.g., a transition ACELP encoder).

The electronic device 340 may determine 804 whether the frame adjustment threshold mode indicates a first frame adjustment threshold set (e.g., a relaxed frame adjustment threshold set). If the frame adjustment threshold mode indicates a first frame adjustment threshold set, the electronic device 340 may set 814 the frame adjustment threshold mode to indicate a second frame adjustment threshold set (e.g., a tightened frame adjustment threshold set). The electronic device 340 may then return to process the next frame as described in connection with FIG. 6.

If the frame adjustment threshold mode does not indicate a first frame adjustment threshold set, the electronic device 340 may determine 806 whether the frame pattern mode indicates a rate-decrease frame pattern. If the frame pattern mode indicates a rate-decrease frame pattern, the electronic device 340 may set 816 the frame pattern mode to indicate a rate-increase frame pattern. The electronic device 340 may then return to process the next frame as described in connection with FIG. 6.

If the frame pattern mode does not indicate a rate-decrease frame pattern, the electronic device 340 may determine 808 if the first threshold is greater than or equal to a first threshold minimum. If the first threshold is greater than or equal to the first threshold minimum, the electronic device 340 may decrease 818 the first threshold to the first threshold minus a second threshold size factor. The second threshold size factor may specify an amount (e.g., step size) for decreasing the first threshold. The electronic device 340 may then return to process the next frame as described in connection with FIG. 6.

If the first threshold is not greater than or equal to the first threshold minimum, the electronic device 340 may determine 810 if the first average rate is less than the target rate minus a second rate tolerance. The second rate tolerance specifies an amount below the target rate. If the first average rate is not less than the target rate minus the second rate tolerance, the electronic device 340 may return to process a next frame as described in connection with FIG. 6.

If the first average rate is less than the target rate minus the second rate tolerance, the electronic device 340 may move 812 one or more low-rate frames to one or more high-rate frames to increase the average encoding rate. In some configurations, this may be based on an EVRC-B rate control algorithm (as described above, for example). The electronic device 340 may return to process a next frame as described in connection with FIG. 6.

As can be observed in FIG. 8, determining the first threshold (and determining the at least one other threshold based on the first threshold), determining a frame pattern, setting the frame adjustment mode (e.g., adjusting frame adjustment thresholds) and/or (directly) adjusting at least one voicing threshold as described in connection with FIG. 3 may be implemented cumulatively (to a reverse effect and in reverse order compared to the method 700 described in connection with FIG. 7). For example, the method 800 may progressively reverse the measures taken in the method 700 described in connection with FIG. 7. For instance, if the first average rate is below a target rate, successive and additional procedures may be performed until the target rate is reached.

Figure 9:
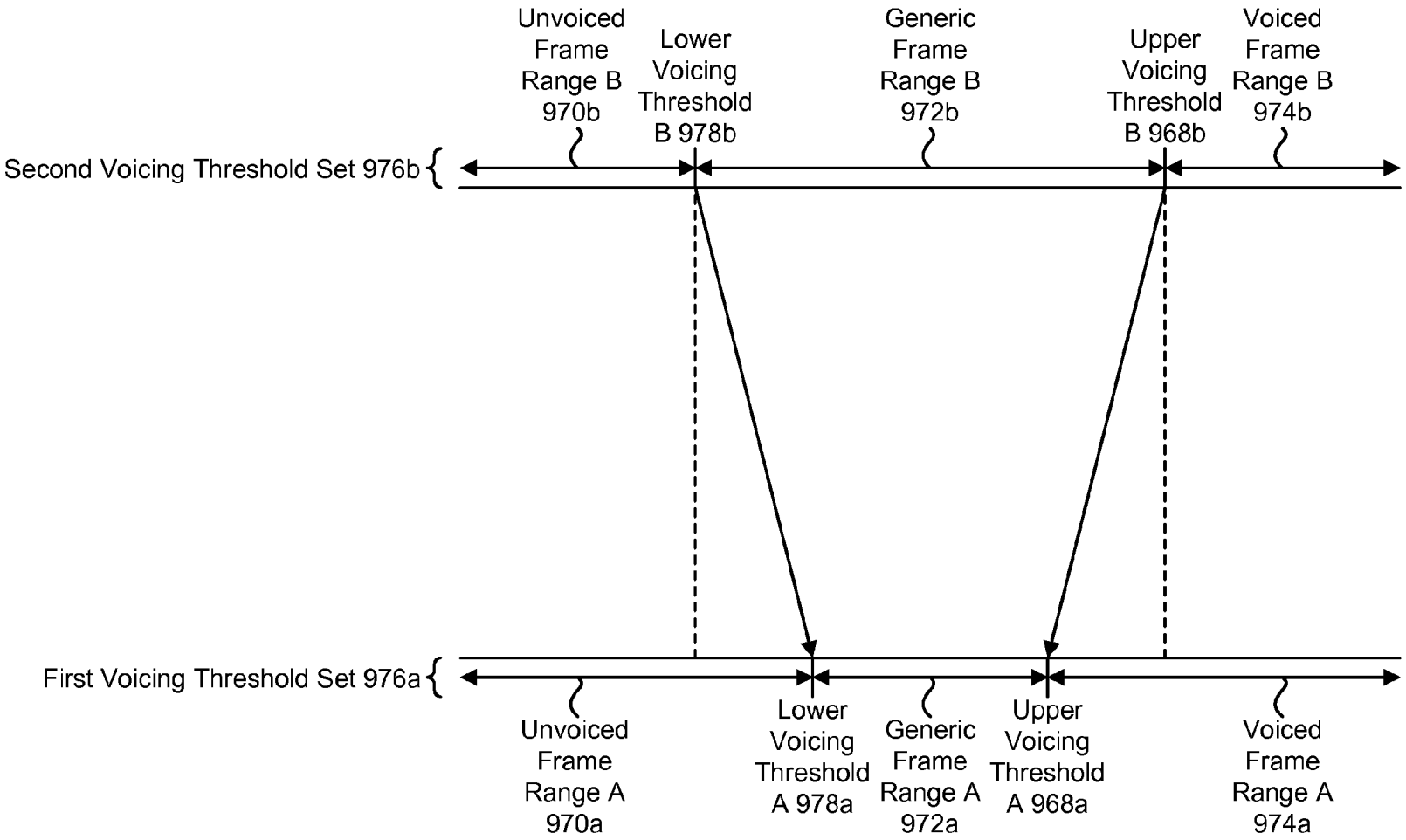
FIG. 9 is a diagram illustrating examples of voicing threshold sets.

FIG. 9 is a diagram illustrating examples of voicing threshold sets 976*a-b*. The horizontal dimension illustrated in FIG. 9 corresponds to a measure of voicing (e.g., a voicing factor). This measure of voicing may not have a unit of measure. The measure of voicing may increase towards the right along the horizontal axes illustrated in FIG. 9. In particular, FIG. 9 illustrates an example of how voicing thresholds 978, 968 may be adjusted. A first voicing threshold set 976*a* (e.g., a relaxed voicing threshold set) may include a lower voicing threshold A 978*a* and an upper voicing threshold A 968*a*. A second voicing threshold set 976*b* (e.g., a tightened voicing threshold set) may include a lower voicing threshold A 978*a* and an upper voicing threshold A 968*a*.

The second voicing threshold set 976*b* may be utilized when the first average rate is within a rate constraint (e.g., when the first average rate is less than or equal to the target rate plus a first tolerance). The first voicing threshold set 976*a* may increase the number of voiced and unvoiced frames. In other words, the voicing thresholds 978*b*, 968*b* included in the second voicing threshold set 976*b* may be adjusted to the voicing thresholds 978*a*, 968*a* included in the first voicing threshold set 976*a* such that fewer generic frames result. It should be noted that adjusting the voicing thresholds may be one example of direct threshold adjustment. For instance, the adjustment of the voicing threshold set based on the first average rate may be one example of direct adjustment of a threshold set.

The threshold sets 976*a-b* may be utilized to classify a frame as a voiced frame, an unvoiced frame or a generic frame. As illustrated in FIG. 9, the second voicing threshold set 976*b* provides unvoiced frame range B 970*b* and voiced frame range B 974*b*, which are larger than unvoiced frame range A 970*a* and voiced frame range A 974*a* provided by the first voicing threshold set 976*a*. Furthermore, the second voicing threshold set 976*b* provides a generic frame range B 972*b* that is larger than the generic frame range A 972*a* provided by the first voicing threshold set 976*a*. Accordingly, a frame is more likely to be classified as a voiced frame or an unvoiced frame based on the first voicing threshold set 976*a* when compared to the second voicing threshold set 976*b*.

For example, more voiced frames and unvoiced frames may result in more QPPP frames (at 2.8 kbps, for example) for voiced frames and NELP frames for unvoiced frames (at 2.8 kbps, for example), which may reduce the average encoding rate. Alternatively, more generic frames may result in more transition ACELP frames (at 8.0 kbps, for example), which may increase the average encoding rate.

Figure 10:
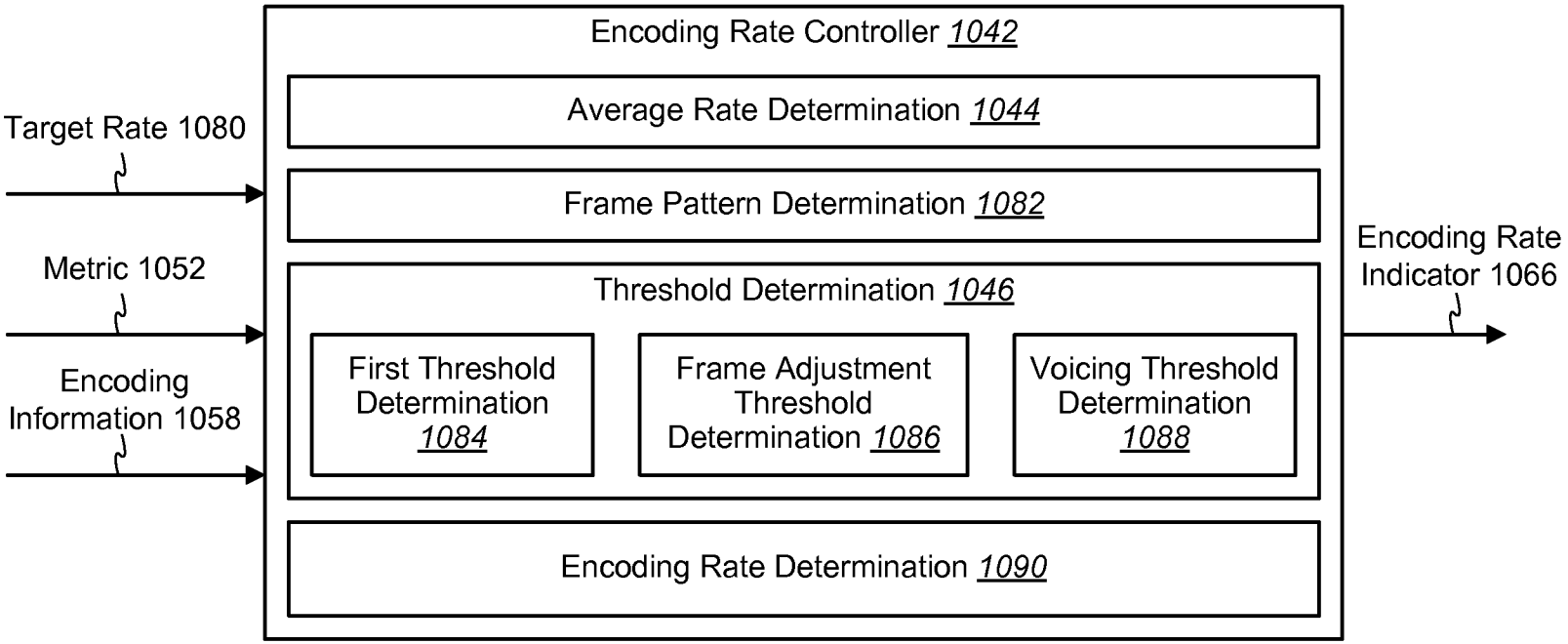
FIG. 10 is a block diagram illustrating one configuration of an encoding rate controller.

FIG. 10 is a block diagram illustrating one configuration of an encoding rate controller 1042. The encoding rate controller 1042 described in connection with FIG. 10 may be one example of the encoding rate controller 342 described in connection with FIG. 3. The encoding rate controller 1042 may include an average rate determination module 1044, a frame pattern determination module 1082, a threshold determination module 1046 and/or an encoding rate determination module 1090. One or more of the components of the encoding rate controller 1042 may be implemented in hardware (e.g., circuitry), software or a combination of both.

The encoding rate controller 1042 may control an average encoding rate based on a target rate 1080, a metric 1052 and encoding information 1058. The encoding rate controller 1042 may control the average encoding rate by attempting to match the average encoding rate to the target rate 1080. The target rate 1080 may be received from another device (e.g., a base station) or may be predetermined.

The encoding rate controller 1042 may provide an encoding rate indicator 1066 to select an encoder for encoding a frame of a speech signal. The encoding rate indicator 1066 specifies a particular encoder, rate and/or frame type. One or more encoders may provide encoding information 1058 to the encoding rate controller 1042. For example, the encoding information 1058 may include an amplitude error metric (e.g., amperror) and a low-band gain change metric (e.g., ΔLgainE). Alternatively, the encoding rate controller 1042 may determine the amplitude error metric and low-band gain change metric based on the encoding information 1058. In some configurations, the encoding information 1058 may include a frame encoding rate. Additionally or alternatively, the encoding rate controller 1042 may obtain the frame encoding rate as indicated by the encoding rate indicator 1066.

The average rate determination module 1044 may determine a first average rate (e.g., a long-term average rate or $R_{LT}$). The average rate determination module 1044 may also determine a short-term average rate (e.g., $R_{lastNframes}$). This may be accomplished as described above in connection with FIG. 3 and/or Equation (1). For instance, the average rate determination module 1044 may determine the short-term average rate and/or the long-term average rate based on the frame encoding rate utilized for each frame. The encoding rate controller 1042 may utilize the short-term average rate and/or the long-term average rate to control the average encoding rate.

The threshold determination module 1046 may determine one or more thresholds. For example, the threshold determination module 1046 may include a first threshold determination module 1084, a frame adjustment threshold determination module 1086 and/or a voicing threshold determination module 1088.

The first threshold determination module 1084 may determine a first threshold (e.g., $TH_{CN}$) based on the first average rate. This may be accomplished as described above. For example, if the first average rate (e.g., $R_{LT}$) is greater than the target rate 1080 (e.g., $R_{target}$) and the first threshold is less than a first threshold maximum, then the threshold determination module 1046 may increase the first threshold by a first threshold size factor. However, if the first average rate (e.g., $R_{LT}$) is less than or equal to the target rate 1080, then the threshold determination module 1046 may decrease the first threshold by a second threshold size factor. The first threshold may be provided to the encoding rate determination module 1090.

The frame adjustment threshold determination module 1086 may determine a frame adjustment threshold set based on the first threshold and the metric 1052. This may be accomplished as described above. For example, the first threshold may be an SNR threshold and the metric 1052 may be an SNR. If the SNR is greater than the first threshold, the frame adjustment determination module 1086 may select a first frame adjustment threshold set. If the SNR is not greater than the first threshold, the frame adjustment determination module 1086 may select a second frame adjustment threshold set. This is one example of indirectly adjusting a frame adjustment threshold set, since the frame adjustment threshold set is determined based on the first threshold. The frame adjustment threshold set may be provided to the encoding rate determination module 1090.

The frame pattern determination module 1082 may determine a frame pattern. The may be accomplished as described above. For example, if the first average rate is greater than the target rate 1080, if the first threshold is greater than or equal to the first threshold maximum, if the frame pattern mode indicates a rate-increase frame pattern and if a second average rate (e.g., short-term average rate or $R_{lastNframes}$) is greater than the target rate 1080, then the frame pattern determination module 1082 may set the frame pattern mode to indicate a rate-decrease frame pattern. The frame pattern mode may be provided to the encoding rate determination module 1090.

The frame adjustment threshold determination module 1086 may adjust the frame adjustment threshold set based on the first average rate. This may be accomplished as described above. For example, if the first average rate is greater than the target rate 1080, if the first threshold is greater than or equal to the first threshold maximum, if the frame pattern mode indicates a rate-decrease frame pattern and the second average rate is greater than the target rate 1080, then the frame adjustment threshold determination module 1086 may set a frame adjustment mode to indicate a first frame adjustment set threshold set. The frame adjustment mode may be provided to the encoding rate determination module 1090. It should be noted that the frame adjustment thresholds may not be controlled directly in some configurations. For example, the frame adjustment thresholds may depend on the first threshold.

The voicing threshold determination module 1088 may adjust a voicing threshold set based on the first average rate. This may be accomplished as described above. For example, if the first average rate is greater than the target rate 1080, if the first threshold is greater than or equal to the first threshold maximum, if the frame pattern mode indicates a rate-decrease frame pattern and the second average rate is greater than the target rate 1080 and if the first average rate is greater than the target rate 1080 plus a first tolerance, then the voicing threshold determination module 1088 may set the voicing threshold mode to indicate a first voicing threshold set. The voicing threshold mode may be provided to the encoding rate determination module 1090.

The encoding rate determination module 1090 may determine the encoding rate indicator 1066 based on the metric 1052, the first threshold, the frame pattern mode, the frame adjustment mode, the voicing threshold mode and/or the encoding information 1058. In some configurations, the encoding rate determination module 1090 may first classify a frame as clean or noisy, then voiced or unvoiced. Then, the encoding rate determination module 1090 may impose or enforce the frame pattern. Finally, the encoding rate determination module 1090 may determine whether to "bump-up" the frame. There may be some instances, however, that a determination in a later state changes an earlier determination. The encoding rate indicator 1066 may be utilized to a select an encoder for encoding the frame as described above.

Figure 11:
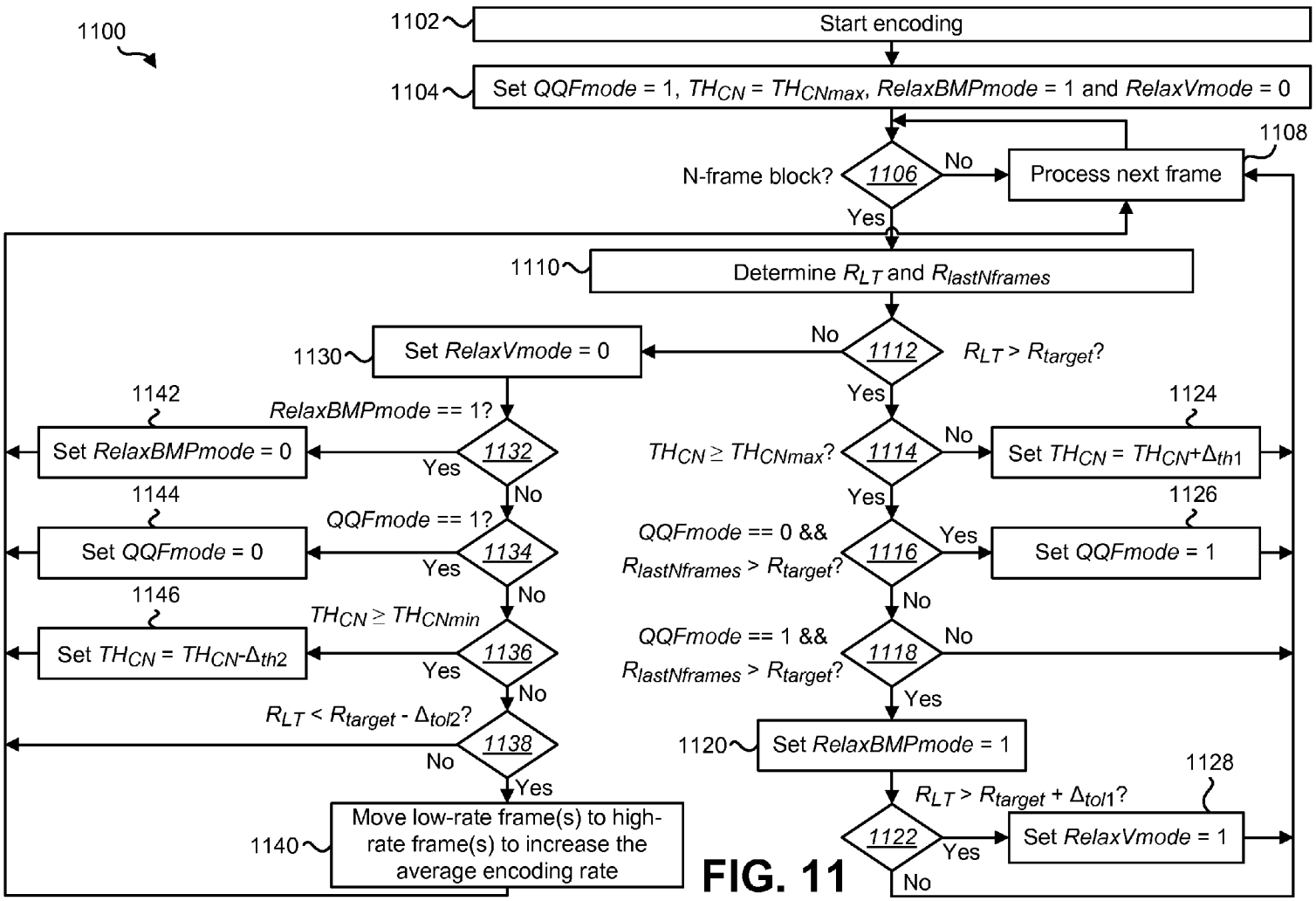
FIG. 11 is a flow diagram illustrating another more specific configuration of a method for controlling an average encoding rate.

FIG. 11 is a flow diagram illustrating another more specific configuration of a method 1100 for controlling an average encoding rate. In particular, FIG. 11 shows a more specific example of one or more of the methods 400, 600, 700, 800 described above in connection with one or more of FIG. 4, FIG. 6, FIG. 7 and FIG. 8. Table (2) provides a summary of the terms and symbols used in FIG. 11.

TABLE (2)

| Term/Symbol | Description |
|---|---|
| QQFmode | One example of the frame pattern mode. QQFmode = 1 indicates that the rate-decrease frame pattern is utilized. QQFmode = 0 indicates that the rate-increase frame pattern is utilized. |
| $TH_{CN}$ | One example of a first threshold. |
| $TH_{CNmax}$ | One example of a first threshold maximum. |
| $TH_{CNmin}$ | One example of a first threshold minimum. |
| RelaxBMPmode | One example of a frame adjustment threshold mode. RelaxBMPmode = 1 indicates that a relaxed frame threshold set is utilized. RelaxBMPmode = 1 indicates that a tightened frame threshold set is utilized. |
| $R_{LT}$ | One example of a long-term average rate. |
| $R_{lastNframes}$ | One example of a short-term average rate. |
| $R_{target}$ | One example of a target rate. |
| $\Delta_{tol1}$ | One example of a first rate tolerance (e.g., set to 0.1 kbps for a 6.1 kbps target rate). |
| $\Delta_{tol2}$ | One example of a second rate tolerance (e.g., set to 0.05 kbps for a 6.1 kbps target rate). |
| $\Delta_{th1}$ | One example of a first threshold size factor (e.g., an amount for increasing $TH_{CN}$). |
| $\Delta_{th2}$ | One example of a second threshold size factor (e.g., an amount for decreasing $TH_{CN}$). |
| RelaxVmode | One example of a voicing threshold mode. RelaxVmode = 1 indicates that a relaxed voicing threshold set is utilized (e.g., more QPPP and NELP frames). RelaxVmode = 0 indicates that a tightened voicing threshold set is utilized. |

An electronic device 340 may start 1102 coding. For example, the electronic device 340 may obtain a speech signal and begin to encode the speech signal as described above.

The electronic device 340 may set 1104 the QQFmode=1, $TH_{CN}=TH_{CNmax}$, RelaxBMPmode=1 and RelaxVmode=0. This is one example of setting default parameters as described above.

The electronic device 340 may determine 1106 whether an N-frame block has been reached. This may be accomplished as described above. If the N-frame block has not been reached, the electronic device 340 may process 1108 a next frame. This may be accomplished as described above.

If the N-frame block has been reached, the electronic device 340 may determine 1110 $R_{LT}$ and $R_{lastNframes}$. $R_{LT}$ and $R_{lastNframes}$ may be determined 1110 as described above.

The electronic device 340 may determine 1112 if $R_{LT}>R_{target}$. If $R_{LT}>R_{target}$ the electronic device 340 may determine 1114 if $TH_{CN}\geq TH_{CNmax}$. If $TH_{CN}<TH_{CNmax}$, the electronic device 340 may set 1124 $TH_{CN}=TH_{CN}+\Delta_{th1}$. The electronic device 340 may return to process 1108 the next frame.

If $TH_{CN}\geq TH_{CNmax}$, the electronic device 340 may determine 1116 whether QQFmode==0 and whether $R_{lastNframes}>R_{target}$. If QQFmode==0 and $R_{lastNframes}>R_{target}$, then the electronic device 340 may set 1126 QQFmode=1. The electronic device 340 may return to process 1108 the next frame.

If QQFmode==1 or $R_{lastNframes}\leq R_{target}$, then the electronic device 340 may determine 1118 whether QQFmode==1 and whether $R_{lastNframes}>R_{target}$. If QQFmode==0 or $R_{lastNframes}\leq R_{target}$, then the electronic device 340 may return to process 1108 the next frame. If QQFmode==1 and $R_{lastNframes}>R_{target}$, then the electronic device 340 may set 1120 RelaxBMPmode=1.

The electronic device 340 may determine 1122 if $R_{LT}>R_{target}+\Delta_{tol1}$. If the $R_{LT}>R_{target}+\Delta_{tol1}$, the electronic device 340 may set 1128 RelaxVmode=1. The electronic device 340 may return to process 1108 the next frame. If $R_{LT}\leq R_{target}+\Delta_{tol1}$, the electronic device 340 may return to process 1108 a next frame.

If $R_{LT}\leq R_{target}$ the electronic device 340 may set 1130 RelaxVmode=0. The electronic device 340 may determine 1132 whether RelaxBMPmode==1. If RelaxBMPmode==1, the electronic device 340 may set 1142 RelaxBMPmode=0. The electronic device 340 may return to process 1108 the next frame.

If RelaxBMPmode==0, the electronic device 340 may determine 1134 whether QQFmode==1. If QQFmode==1, the electronic device 340 may set 1144 QQFmode=0. The electronic device 340 may return to process 1108 the next frame.

If QQFmode==0, the electronic device 340 may determine 1136 if $TH_{CN}\geq TH_{CNmin}$. If $TH_{CN}\geq TH_{CNmin}$, the electronic device 340 may set 1146 $TH_{CN}=TH_{CN}-\Delta_{th2}$. The electronic device 340 may return to process 1108 the next frame.

If $TH_{CN}<TH_{CNmin}$, the electronic device 340 may determine 1138 if $R_{LT}<R_{target}-\Delta_{tol2}$. If $R_{LT}\geq R_{target}+\Delta_{tol1}$, the electronic device 340 may return to process 1108 the next frame.

If $R_{LT}<R_{target}-\Delta_{tol2}$, the electronic device 340 may move 1140 one or more low-rate frames to one or more high-rate frames to increase the average encoding rate. In some configurations, this may be based on an EVRC-B rate control algorithm. The electronic device 340 may return to process 1108 the next frame.

Figure 12:
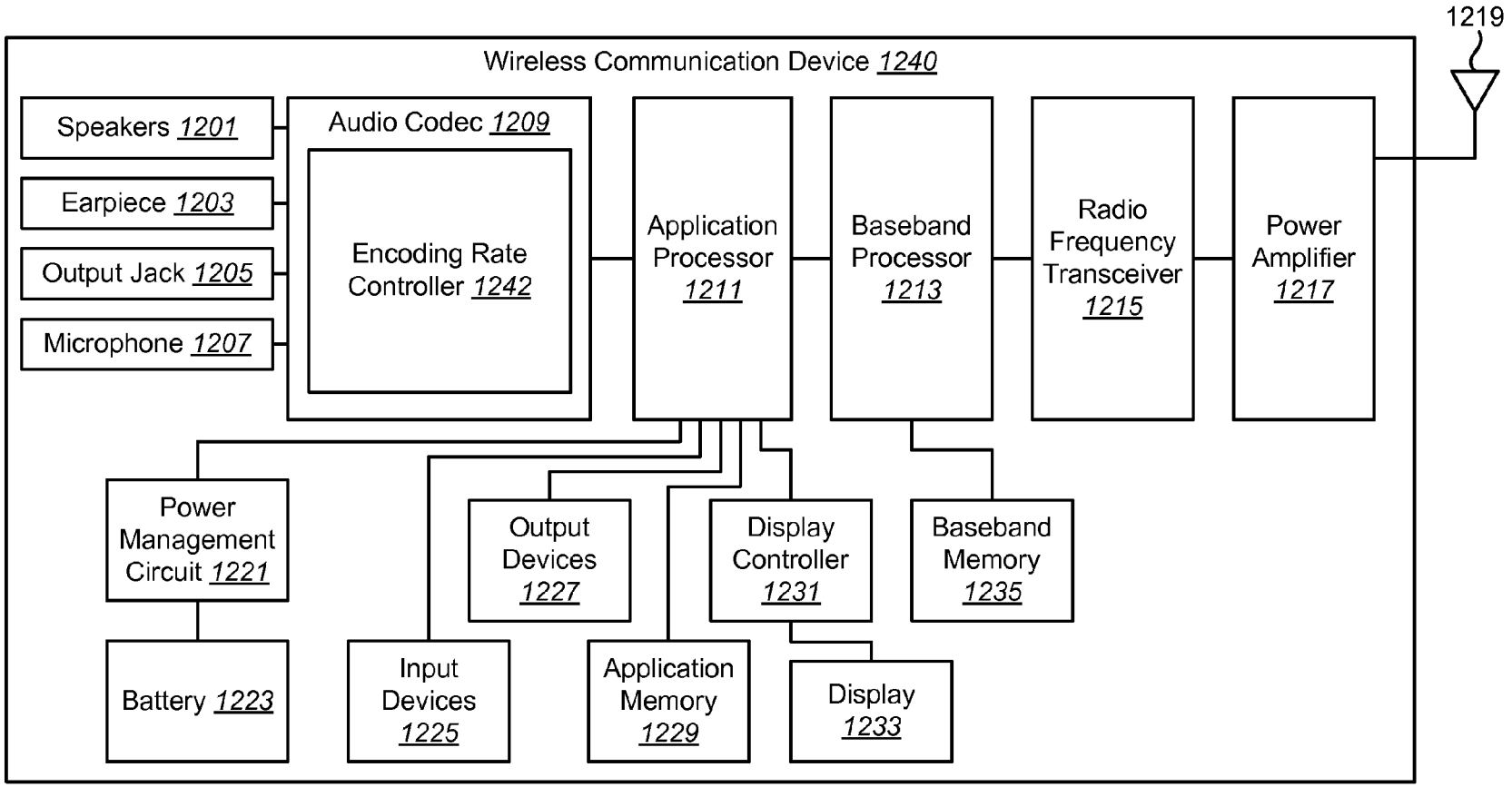
FIG. 12 is a block diagram illustrating one configuration of a wireless communication device.

FIG. 12 is a block diagram illustrating one configuration of a wireless communication device 1240 in which systems and methods for controlling an average encoding rate may be implemented. The wireless communication device 1240 illustrated in FIG. 12 may be an example of at least one of the electronic devices described herein. The wireless communication device 1240 may include an application processor 1211. The application processor 1211 generally processes instructions (e.g., runs programs) to perform functions on the wireless communication device 1240. The application processor 1211 may be coupled to an audio coder/decoder (codec) 1209.

The audio codec 1209 may be used for coding and/or decoding audio signals. The audio codec 1209 may be coupled to at least one speaker 1201, an earpiece 1203, an output jack 1205 and/or at least one microphone 1207. The speakers 1201 may include one or more electro-acoustic transducers that convert electrical or electronic signals into acoustic signals. For example, the speakers 1201 may be used to play music or output a speakerphone conversation, etc. The earpiece 1203 may be another speaker or electro-acoustic transducer that can be used to output acoustic signals (e.g., speech signals) to a user. For example, the earpiece 1203 may be used such that only a user may reliably hear the acoustic signal. The output jack 1205 may be used for coupling other devices to the wireless communication device 1240 for outputting audio, such as headphones. The speakers 1201, earpiece 1203 and/or output jack 1205 may generally be used for outputting an audio signal from the audio codec 1209. The at least one microphone 1207 may be an acousto-electric transducer that converts an acoustic signal (such as a user's voice) into electrical or electronic signals that are provided to the audio codec 1209.

The audio codec 1209 (e.g., a decoder) may include an encoding rate controller 1242. The encoding rate controller 1242 may be an example of one or more of the encoding rate controllers 342, 1042 described above. In some configurations, the audio codec 1209 may include multiple encoders (e.g., encoders 356*a-n*).

The application processor 1211 may also be coupled to a power management circuit 1221. One example of a power management circuit 1221 is a power management integrated circuit (PMIC), which may be used to manage the electrical power consumption of the wireless communication device 1240. The power management circuit 1221 may be coupled to a battery 1223. The battery 1223 may generally provide electrical power to the wireless communication device 1240. For example, the battery 1223 and/or the power management circuit 1221 may be coupled to at least one of the elements included in the wireless communication device 1240.

The application processor 1211 may be coupled to at least one input device 1225 for receiving input. Examples of input devices 1225 include infrared sensors, image sensors, accelerometers, touch sensors, keypads, etc. The input devices 1225 may allow user interaction with the wireless communication device 1240. The application processor 1211 may also be coupled to one or more output devices 1227. Examples of output devices 1227 include printers, projectors, screens, haptic devices, etc. The output devices 1227 may allow the wireless communication device 1240 to produce output that may be experienced by a user.

The application processor 1211 may be coupled to application memory 1229. The application memory 1229 may be any electronic device that is capable of storing electronic information. Examples of application memory 1229 include double data rate synchronous dynamic random access memory (DDRAM), synchronous dynamic random access memory (SDRAM), flash memory, etc. The application memory 1229 may provide storage for the application processor 1211. For instance, the application memory 1229 may store data and/or instructions for the functioning of programs that are run on the application processor 1211.

The application processor 1211 may be coupled to a display controller 1231, which in turn may be coupled to a display 1233. The display controller 1231 may be a hardware block that is used to generate images on the display 1233. For example, the display controller 1231 may translate instructions and/or data from the application processor 1211 into images that can be presented on the display 1233. Examples of the display 1233 include liquid crystal display (LCD) panels, light emitting diode (LED) panels, cathode ray tube (CRT) displays, plasma displays, etc.

The application processor 1211 may be coupled to a baseband processor 1213. The baseband processor 1213 generally processes communication signals. For example, the baseband processor 1213 may demodulate and/or decode received signals. Additionally or alternatively, the baseband processor 1213 may encode and/or modulate signals in preparation for transmission.

The baseband processor 1213 may be coupled to baseband memory 1235. The baseband memory 1235 may be any electronic device capable of storing electronic information, such as SDRAM, DDRAM, flash memory, etc. The baseband processor 1213 may read information (e.g., instructions and/or data) from and/or write information to the baseband memory 1235. Additionally or alternatively, the baseband processor 1213 may use instructions and/or data stored in the baseband memory 1235 to perform communication operations.

The baseband processor 1213 may be coupled to a radio frequency (RF) transceiver 1215. The RF transceiver 1215 may be coupled to a power amplifier 1217 and one or more antennas 1219. The RF transceiver 1215 may transmit and/or receive radio frequency signals. For example, the RF transceiver 1215 may transmit an RF signal using a power amplifier 1217 and at least one antenna 1219. The RF transceiver 1215 may also receive RF signals using the one or more antennas 1219.

Figure 13:
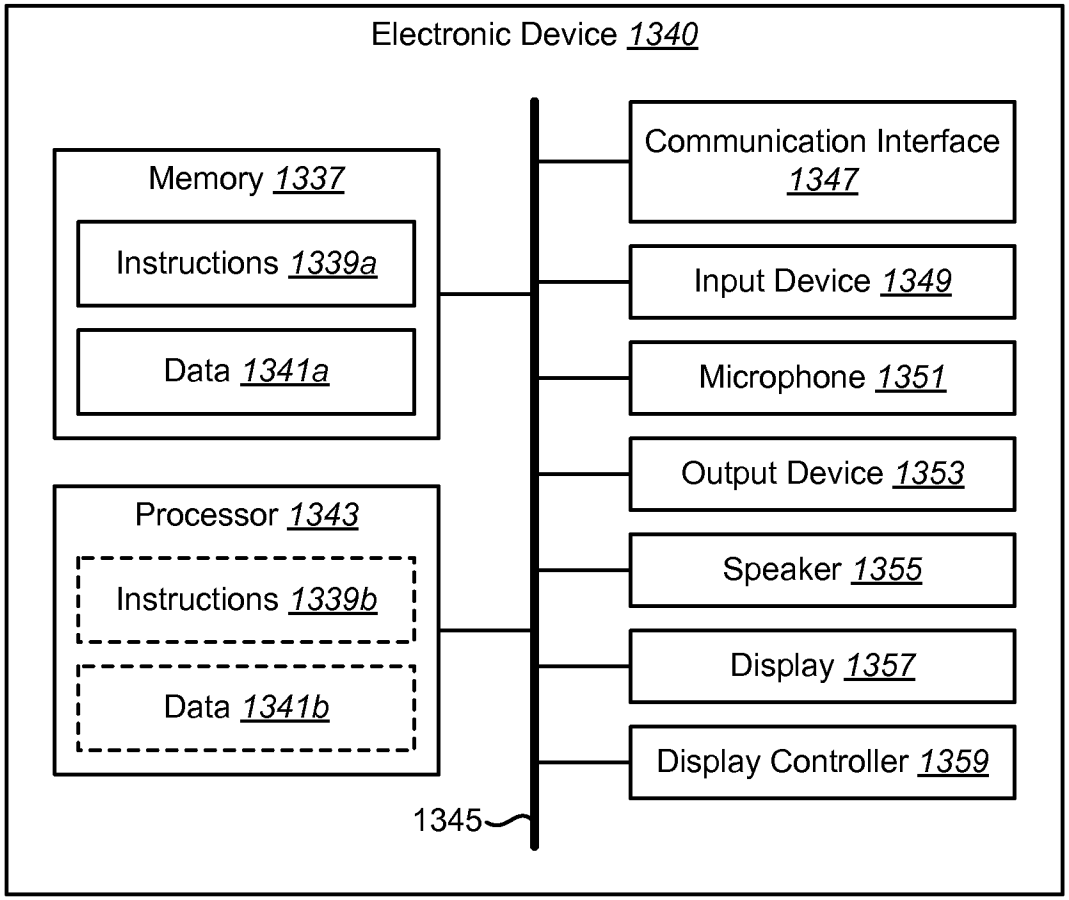
FIG. 13 illustrates various components that may be utilized in an electronic device.

FIG. 13 illustrates various components that may be utilized in an electronic device 1340. The illustrated components may be located within the same physical structure or in separate housings or structures. The electronic device 1340 described in connection with FIG. 13 may be implemented in accordance with one or more of the electronic devices described herein. The electronic device 1340 includes a processor 1343. The processor 1343 may be a general purpose single- or multi-chip microprocessor (e.g., an ARM), a special purpose microprocessor (e.g., a digital signal processor (DSP)), a microcontroller, a programmable gate array, etc. The processor 1343 may be referred to as a central processing unit (CPU). Although just a single processor 1343 is shown in the electronic device 1340 of FIG. 13, in an alternative configuration, a combination of processors (e.g., an ARM and DSP) could be used.

The electronic device 1340 also includes memory 1337 in electronic communication with the processor 1343. That is, the processor 1343 can read information from and/or write information to the memory 1337. The memory 1337 may be any electronic component capable of storing electronic information. The memory 1337 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1341*a* and instructions 1339*a* may be stored in the memory 1337. The instructions 1339*a* may include one or more programs, routines, sub-routines, functions, procedures, etc. The instructions 1339*a* may include a single computer-readable statement or many computer-readable statements. The instructions 1339*a* may be executable by the processor 1343 to implement one or more of the methods, functions and procedures described above. Executing the instructions 1339*a* may involve the use of the data 1341*a* that is stored in the memory 1337. FIG. 13 shows some instructions 1339*b* and data 1341*b* being loaded into the processor 1343 (which may come from instructions 1339*a* and data 1341*a*).

The electronic device 1340 may also include one or more communication interfaces 1347 for communicating with other electronic devices. The communication interfaces 1347 may be based on wired communication technology, wireless communication technology, or both. Examples of different types of communication interfaces 1347 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1340 may also include one or more input devices 1349 and one or more output devices 1353. Examples of different kinds of input devices 1349 include a keyboard, mouse, microphone, remote control device, button, joystick, trackball, touchpad, lightpen, etc. For instance, the electronic device 1340 may include one or more microphones 1351 for capturing acoustic signals. In one configuration, a microphone 1351 may be a transducer that converts acoustic signals (e.g., voice, speech) into electrical or electronic signals. Examples of different kinds of output devices 1353 include a speaker, printer, etc. For instance, the electronic device 1340 may include one or more speakers 1355. In one configuration, a speaker 1355 may be a transducer that converts electrical or electronic signals into acoustic signals. One specific type of output device which may be typically included in an electronic device 1340 is a display device 1357. Display devices 1357 used with configurations disclosed herein may utilize any suitable image projection technology, such as a cathode ray tube (CRT), liquid crystal display (LCD), light-emitting diode (LED), gas plasma, electroluminescence, or the like. A display controller 1359 may also be provided, for converting data stored in the memory 1337 into text, graphics, and/or moving images (as appropriate) shown on the display device 1357.

The various components of the electronic device 1340 may be coupled together by one or more buses, which may include a power bus, a control signal bus, a status signal bus, a data bus, etc. For simplicity, the various buses are illustrated in FIG. 13 as a bus system 1345. It should be noted that FIG. 13 illustrates only one possible configuration of an electronic device 1340. Various other architectures and components may be utilized.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

It should be noted that one or more of the features, functions, procedures, components, elements, structures, etc., described in connection with any one of the configurations described herein may be combined with one or more of the functions, procedures, components, elements, structures, etc., described in connection with any of the other configurations described herein, where compatible. In other words, any compatible combination of the functions, procedures, components, elements, etc., described herein may be implemented in accordance with the systems and methods disclosed herein.

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for controlling an average encoding rate by an electronic device, comprising:

obtaining a speech signal;

framing the speech signal to produce a current frame;

determining a first average rate based on past frames;

determining a first threshold based on the first average rate;

controlling the average encoding rate by controlling (A) an adjustable first threshold to determine at least one other threshold, (B) a selectable frame pattern, (C) an adjustable frame adjustment threshold, and (D) an adjustable voicing threshold to classify the current frame;

selecting an encoder based on the frame classification; and sending an encoded speech signal.

2. The method of claim 1, wherein controlling the average encoding rate further comprises determining a frame pattern.

3. The method of claim 2, wherein a first frame pattern requires a minimum number of high-rate frames between low-rate frames and a second frame pattern only allows a maximum number of low-rate frames between high-rate frames.

4. The method of claim 1, wherein controlling the average encoding rate further comprises:

determining whether the first average rate is greater than a target rate;

in response to determining that the first average rate is greater than the target rate, determining whether the first threshold is greater than or equal to a first threshold maximum;

in response to determining that the first threshold is not greater than or equal to the first threshold maximum, increasing the first threshold;

in response to determining that the first threshold is greater than or equal to the first threshold maximum, determining whether a frame pattern mode indicates a rate-increase frame pattern and whether a second average rate is greater than the target rate;

in response to determining that the frame pattern mode indicates a rate-increase frame pattern and that the second average rate is greater than the target rate, setting the frame pattern mode to indicate a rate-decrease frame pattern;

in response to determining that the frame pattern mode does not indicate a rate-increase frame pattern or that the second average rate is not greater than the target rate, determining whether the frame pattern mode indicates a rate-decrease frame pattern and whether the second average rate is greater than the target rate;

in response to determining that the frame pattern mode indicates a rate-decrease frame pattern and that the second average rate is greater than the target rate, setting a frame adjustment mode to indicate a first frame adjustment threshold set and determining whether the first average rate is greater than the target rate plus a first tolerance; and in response to determining that the first average rate is greater than the target rate plus the first tolerance, setting a voicing threshold mode to indicate a first voicing threshold set.

5. The method of claim 1, wherein controlling the average encoding rate further comprises:

determining whether the first average rate is greater than a target rate;

in response to determining that the first average rate is not greater than the target rate, setting a voicing threshold mode to indicate a second voicing threshold set and determining whether a frame adjustment threshold mode indicates a first frame adjustment threshold set;

in response to determining that the frame adjustment threshold mode indicates the first frame adjustment threshold set, setting the frame adjustment threshold mode to indicate a second frame adjustment threshold set;

in response to determining that the frame adjustment threshold mode does not indicate the first frame adjustment threshold set, determining whether a frame pattern mode indicates a rate-decrease frame pattern;

in response to determining that the frame pattern mode indicates a rate-decrease frame pattern, setting the frame pattern mode to indicate a rate-increase frame pattern;

in response to determining that the frame pattern mode does not indicate a rate-decrease frame pattern, determining whether the first threshold is greater than or equal to the first threshold minimum;

in response to determining that the first threshold is greater than or equal to the first threshold minimum, decreasing the first threshold;

in response to determining that the first threshold is not greater than or equal to the first threshold minimum, determining whether the first average rate is less than the target rate minus a second rate tolerance; and in response to determining that the first average rate is less than the target rate minus the second rate tolerance, moving one or more low-rate frames to high-rate frames to increase the average encoding rate.

6. The method of claim 1, wherein determining the at least one other threshold is further based on a metric.

7. The method of claim 6, wherein determining the at least one other threshold comprises:

selecting a first threshold set if the metric is not greater than the first threshold; and selecting a second threshold set if the metric is greater than the first threshold.

8. The method of claim 7, wherein the first threshold set is a first frame adjustment threshold set and the second threshold set is a second frame adjustment threshold set.

9. The method of claim 4, wherein controlling the average encoding rate comprises utilizing a procedure with lesser potential impact to speech quality before utilizing one or more procedures with increasing potential impact to speech quality when lowering the average encoding rate.

10. The method of claim 1, wherein controlling the average encoding rate further comprises adjusting at least one voicing threshold based on the first average rate.

11. The method of claim 10, wherein adjusting the at least one voicing threshold comprises selecting a voicing threshold set.

12. An electronic device for controlling an average encoding rate, comprising:

average rate determination circuitry configured to determine a first average rate based on past frames;

framing circuitry configured to frame a speech signal to produce a current frame;

threshold determination circuitry configured to determine a first threshold based on the first average rate; and encoding rate controller circuitry that comprises the average rate determination circuitry and the threshold determination circuitry, wherein the encoding rate controller is configured to control the average encoding rate by controlling (A) an adjustable first threshold to determine at least one other threshold, (B) a selectable frame pattern, (C) an adjustable frame adjustment threshold, and (D) an adjustable voicing threshold to classify the current frame, and is configured to select an encoder based on the frame classification.

13. The electronic device of claim 12, wherein the electronic device is configured to determine a frame pattern.

14. The electronic device of claim 13, wherein a first frame pattern requires a minimum number of high-rate frames between low-rate frames and a second frame pattern only allows a maximum number of low-rate frames between high-rate frames.

15. The electronic device of claim 12, wherein the electronic device is configured to:

determine whether the first average rate is greater than a target rate;

in response to determining that the first average rate is greater than the target rate, to determine whether the first threshold is greater than or equal to a first threshold maximum;

in response to determining that the first threshold is not greater than or equal to the first threshold maximum, to increase the first threshold;

in response to determining that the first threshold is greater than or equal to the first threshold maximum, to determine whether a frame pattern mode indicates a rate-increase frame pattern and whether a second average rate is greater than the target rate;

in response to determining that the frame pattern mode indicates a rate-increase frame pattern and that the second average rate is greater than the target rate, to set the frame pattern mode to indicate a rate-decrease frame pattern;

in response to determining that the frame pattern mode does not indicate a rate-increase frame pattern or that the second average rate is not greater than the target rate, to determine whether the frame pattern mode indicates a rate-decrease frame pattern and whether the second average rate is greater than the target rate;

in response to determining that the frame pattern mode indicates a rate-decrease frame pattern and that the second average rate is greater than the target rate, to set a frame adjustment mode to indicate a first frame adjustment threshold set and to determine whether the first average rate is greater than the target rate plus a first tolerance; and in response to determining that the first average rate is greater than the target rate plus the first tolerance, to set a voicing threshold mode to indicate a first voicing threshold set.

16. The electronic device of claim 12, wherein the electronic device is configured to:

determine whether the first average rate is greater than a target rate;

in response to determining that the first average rate is not greater than the target rate, to set a voicing threshold mode to indicate a second voicing threshold set and to determine whether a frame adjustment threshold mode indicates a first frame adjustment threshold set;

in response to determining that the frame adjustment threshold mode indicates the first frame adjustment threshold set, to set the frame adjustment threshold mode to indicate a second frame adjustment threshold set;

in response to determining that the frame adjustment threshold mode does not indicate the first frame adjustment threshold set, to determine whether a frame pattern mode indicates a rate-decrease frame pattern;

in response to determining that the frame pattern mode indicates a rate-decrease frame pattern, to set the frame pattern mode to indicate a rate-increase frame pattern;

in response to determining that the frame pattern mode does not indicate a rate-decrease frame pattern, to determine whether the first threshold is greater than or equal to the first threshold minimum;

in response to determining that the first threshold is greater than or equal to the first threshold minimum, to decrease the first threshold;

in response to determining that the first threshold is not greater than or equal to the first threshold minimum, to determine whether the first average rate is less than the target rate minus a second rate tolerance; and in response to determining that the first average rate is less than the target rate minus the second rate tolerance, to move one or more low-rate frames to high-rate frames to increase the average encoding rate.

17. The electronic device of claim 12, wherein the electronic device is configured to determine the at least one other threshold based on a metric.

18. The electronic device of claim 17, wherein the electronic device is configured to:

select a first threshold set if the metric is not greater than the first threshold; and select a second threshold set if the metric is greater than the first threshold.

19. The electronic device of claim 18, wherein the first threshold set is a first frame adjustment threshold set and the second threshold set is a second frame adjustment threshold set.

20. The electronic device of claim 15, wherein the electronic device is configured to utilize a procedure with lesser potential impact to speech quality before utilizing one or more procedures with increasing potential impact to speech quality when lowering the average encoding rate.

21. The electronic device of claim 12, wherein the electronic device is configured to adjust at least one voicing threshold based on the first average rate.

22. The electronic device of claim 21, wherein the electronic device is configured to select a voicing threshold set.

23. A computer-program product for controlling an average encoding rate, comprising a non-transitory tangible computer-readable medium having instructions thereon, the instructions comprising:

code for causing an electronic device to obtain a speech signal;

code for causing the electronic device to frame the speech signal to produce a current frame;

code for causing the electronic device to determine a first average rate based on past frames;

code for causing the electronic device to determine a first threshold based on the first average rate;

code for causing the electronic device to control the average encoding rate by controlling (A) an adjustable first threshold to determine at least one other threshold, (B) a selectable frame pattern, (C) an adjustable frame adjustment threshold, and (D) an adjustable voicing threshold to classify the current frame;

code for causing the electronic device to select an encoder based on the frame classification; and code for causing the electronic device to send an encoded speech signal.

24. The computer-program product of claim 23, wherein controlling the average encoding rate further comprises determining a frame pattern.

25. The computer-program product of claim 24, wherein a first frame pattern requires a minimum number of high-rate frames between low-rate frames and a second frame pattern only allows a maximum number of low-rate frames between high-rate frames.

26. The computer-program product of claim 23, wherein controlling the average encoding rate further comprises:

determining whether the first average rate is greater than a target rate;

in response to determining that the first average rate is greater than the target rate, determining whether the first threshold is greater than or equal to a first threshold maximum;

in response to determining that the first threshold is not greater than or equal to the first threshold maximum, increasing the first threshold;

in response to determining that the first threshold is greater than or equal to the first threshold maximum, determining whether a frame pattern mode indicates a rate-increase frame pattern and whether a second average rate is greater than the target rate;

in response to determining that the frame pattern mode indicates a rate-increase frame pattern and that the second average rate is greater than the target rate, setting the frame pattern mode to indicate a rate-decrease frame pattern;

in response to determining that the frame pattern mode does not indicate a rate-increase frame pattern or that the second average rate is not greater than the target rate, determining whether the frame pattern mode indicates a rate-decrease frame pattern and whether the second average rate is greater than the target rate;

in response to determining that the frame pattern mode indicates a rate-decrease frame pattern and that the second average rate is greater than the target rate, setting a frame adjustment mode to indicate a first frame adjustment threshold set and determining whether the first average rate is greater than the target rate plus a first tolerance; and in response to determining that the first average rate is greater than the target rate plus the first tolerance, setting a voicing threshold mode to indicate a first voicing threshold set.

27. The computer-program product of claim 23, wherein controlling the average encoding rate further comprises:

determining whether the first average rate is greater than a target rate;

in response to determining that the first average rate is not greater than the target rate, setting a voicing threshold mode to indicate a second voicing threshold set and determining whether a frame adjustment threshold mode indicates a first frame adjustment threshold set;

in response to determining that the frame adjustment threshold mode indicates the first frame adjustment threshold set, setting the frame adjustment threshold mode to indicate a second frame adjustment threshold set;

in response to determining that the frame adjustment threshold mode does not indicate the first frame adjustment threshold set, determining whether a frame pattern mode indicates a rate-decrease frame pattern;

in response to determining that the frame pattern mode indicates a rate-decrease frame pattern, setting the frame pattern mode to indicate a rate-increase frame pattern;

in response to determining that the frame pattern mode does not indicate a rate-decrease frame pattern, determining whether the first threshold is greater than or equal to the first threshold minimum;

in response to determining that the first threshold is greater than or equal to the first threshold minimum, decreasing the first threshold;

in response to determining that the first threshold is not greater than or equal to the first threshold minimum, determining whether the first average rate is less than the target rate minus a second rate tolerance; and in response to determining that the first average rate is less than the target rate minus the second rate tolerance, moving one or more low-rate frames to high-rate frames to increase the average encoding rate.

28. The computer-program product of claim 23, wherein determining the at least one other threshold is further based on a metric.

29. The computer-program product of claim 28, wherein determining the at least one other threshold comprises:

selecting a first threshold set if the metric is not greater than the first threshold; and selecting a second threshold set if the metric is greater than the first threshold.

30. The computer-program product of claim 29, wherein the first threshold set is a first frame adjustment threshold set and the second threshold set is a second frame adjustment threshold set.

31. The computer-program product of claim 26, wherein controlling the average encoding rate comprises utilizing a procedure with lesser potential impact to speech quality before utilizing one or more procedures with increasing potential impact to speech quality when lowering the average encoding rate.

32. The computer-program product of claim 23, wherein controlling the average encoding rate further comprises adjusting at least one voicing threshold based on the first average rate.

33. The computer-program product of claim 32, wherein adjusting the at least one voicing threshold comprises selecting a voicing threshold set.

34. An apparatus for controlling an average encoding rate, comprising:

means for obtaining a speech signal;

means for framing the speech signal to produce a current frame;

means for determining a first average rate based on past frames;

means for determining a first threshold based on the first average rate;

means for controlling the average encoding rate by controlling (A) an adjustable first threshold to determine at least one other threshold, (B) a selectable frame pattern, (C) an adjustable frame adjustment threshold, and (D) an adjustable voicing threshold to classify the current frame;

means for selecting an encoder based on the frame classification; and means for sending an encoded speech signal.

35. The apparatus of claim 34, wherein controlling the average encoding rate further comprises determining a frame pattern.

36. The apparatus of claim 35, wherein a first frame pattern requires a minimum number of high-rate frames between low-rate frames and a second frame pattern only allows a maximum number of low-rate frames between high-rate frames.

37. The apparatus of claim 34, wherein the means for controlling the average encoding rate further comprises:

determining whether the first average rate is greater than a target rate;

in response to determining that the first average rate is greater than the target rate, determining whether the first threshold is greater than or equal to a first threshold maximum;

in response to determining that the first threshold is not greater than or equal to the first threshold maximum, increasing the first threshold;

in response to determining that the first threshold is greater than or equal to the first threshold maximum, determining whether a frame pattern mode indicates a rate-increase frame pattern and whether a second average rate is greater than the target rate;

in response to determining that the frame pattern mode indicates a rate-increase frame pattern and that the second average rate is greater than the target rate, setting the frame pattern mode to indicate a rate-decrease frame pattern;

in response to determining that the frame pattern mode does not indicate a rate-increase frame pattern or that the second average rate is not greater than the target rate, determining whether the frame pattern mode indicates a rate-decrease frame pattern and whether the second average rate is greater than the target rate;

in response to determining that the frame pattern mode indicates a rate-decrease frame pattern and that the second average rate is greater than the target rate, setting a frame adjustment mode to indicate a first frame adjustment threshold set and determining whether the first average rate is greater than the target rate plus a first tolerance; and in response to determining that the first average rate is greater than the target rate plus the first tolerance, setting a voicing threshold mode to indicate a first voicing threshold set.

38. The apparatus of claim 34, wherein the means for controlling the average encoding rate further comprises:

determining whether the first average rate is greater than a target rate;

in response to determining that the first average rate is not greater than the target rate, setting a voicing threshold mode to indicate a second voicing threshold set and determining whether a frame adjustment threshold mode indicates a first frame adjustment threshold set;

in response to determining that the frame adjustment threshold mode indicates the first frame adjustment threshold set, setting the frame adjustment threshold mode to indicate a second frame adjustment threshold set;

in response to determining that the frame adjustment threshold mode does not indicate the first frame adjustment threshold set, determining whether a frame pattern mode indicates a rate-decrease frame pattern;

in response to determining that the frame pattern mode indicates a rate-decrease frame pattern, setting the frame pattern mode to indicate a rate-increase frame pattern;

in response to determining that the frame pattern mode does not indicate a rate-decrease frame pattern, determining whether the first threshold is greater than or equal to the first threshold minimum;

in response to determining that the first threshold is greater than or equal to the first threshold minimum, decreasing the first threshold;

in response to determining that the first threshold is not greater than or equal to the first threshold minimum, determining whether the first average rate is less than the target rate minus a second rate tolerance; and in response to determining that the first average rate is less than the target rate minus the second rate tolerance, moving one or more low-rate frames to high-rate frames to increase the average encoding rate.

39. The apparatus of claim 34, wherein determining the at least one other threshold is further based on a metric.

40. The apparatus of claim 39, wherein determining the at least one other threshold comprises:

selecting a first threshold set if the metric is not greater than the first threshold; and selecting a second threshold set if the metric is greater than the first threshold.

41. The apparatus of claim 40, wherein the first threshold set is a first frame adjustment threshold set and the second threshold set is a second frame adjustment threshold set.

42. The apparatus of claim 37, wherein controlling the average encoding rate comprises utilizing a procedure with lesser potential impact to speech quality before utilizing one or more procedures with increasing potential impact to speech quality when lowering the average encoding rate.

43. The apparatus of claim 34, wherein controlling the average encoding rate further comprises adjusting at least one voicing threshold based on the first average rate.

44. The apparatus of claim 43, wherein adjusting the at least one voicing threshold comprises selecting a voicing threshold set.

* * * * *